US009090080B2

(12) United States Patent
Sugaya et al.

(10) Patent No.: US 9,090,080 B2
(45) Date of Patent: Jul. 28, 2015

(54) IMAGE FORMATION DEVICE

(71) Applicants: KONICA MINOLTA, INC., Chiyoda-ku (JP); KOMORI CORPORATION, Sumida-ku (JP)

(72) Inventors: Toyoaki Sugaya, Hachioji (JP); Mitsuru Obata, Sagamihara (JP); Hiroyuki Suda, Higashi Okitama-gun (JP); Satoshi Murakami, Sumida-ku (JP)

(73) Assignees: KONICA MINOLTA, INC., Tokyo (JP); KOMORI CORPORATION, Tokyo (JP)

( * ) Notice: Subject to any disclaimer, the term of this patent is extended or adjusted under 35 U.S.C. 154(b) by 0 days.

(21) Appl. No.: 14/398,694

(22) PCT Filed: Apr. 30, 2013

(86) PCT No.: PCT/JP2013/062643
§ 371 (c)(1),
(2) Date: Nov. 3, 2014

(87) PCT Pub. No.: WO2013/165003
PCT Pub. Date: Nov. 7, 2013

(65) Prior Publication Data

US 2015/0124029 A1 May 7, 2015

(30) Foreign Application Priority Data

May 1, 2012 (JP) ..... 2012-104619

(51) Int. Cl.

| | |
|---|---|
| ***B41J 2/01*** | (2006.01) |
| ***B41J 2/175*** | (2006.01) |
| ***B41J 11/00*** | (2006.01) |
| ***B41J 3/60*** | (2006.01) |

(52) U.S. Cl.
CPC ..... *B41J 2/17593* (2013.01); *B41J 3/60* (2013.01); *B41J 11/002* (2013.01); *B41J 11/007* (2013.01)

(58) Field of Classification Search
CPC ..... B41J 11/002; B41J 3/60; B41J 2/01; B41J 13/223; B41J 15/165; B41J 3/543; B41J 2/0057; B41J 15/042
USPC ..... 347/16, 88, 101, 102, 104
See application file for complete search history.

(56) References Cited

U.S. PATENT DOCUMENTS

| | | | | |
|---|---|---|---|---|
| 7,874,664 | B2 * | 1/2011 | Gervasi et al. | 347/103 |
| 8,534,826 | B2 * | 9/2013 | Kobayashi et al. | 347/102 |
| 8,814,347 | B2 * | 8/2014 | Sugaya et al. | 347/102 |

FOREIGN PATENT DOCUMENTS

| | | |
|---|---|---|
| JP | 5-169649 | 7/1993 |
| JP | 10-138526 | 5/1998 |

(Continued)

*Primary Examiner* — An Do
(74) *Attorney, Agent, or Firm* — Cozen O'Conner

(57) ABSTRACT

Image formation device having: an image formation drum (50) for rotationally conveying a recording medium while holding the recording medium; a supply means (22) for supplying the recording medium (P) to the drum; a recording head (71) for forming an image on the recording medium on the drum; and a conveyance mechanism (80) for receiving the recording medium from the drum at a reception position (m2) on the downstream side in a conveyance direction from the recording head and distributing the recording medium to a paper discharge path or an inversion path. The conveyance mechanism returns the recording medium to the drum at a return position (m9) on the downstream side in the conveyance direction from the reception position (m2) after the front and back surfaces thereof are inverted, and a drum heating means (94) for heating the surface drum is provided between the reception position and the return position.

7 Claims, 6 Drawing Sheets

(56) References Cited

FOREIGN PATENT DOCUMENTS

| | | |
|---|---|---|
| JP | 2004-82689 | 3/2004 |
| JP | 2006-213415 | 8/2006 |
| JP | 2006-232512 | 9/2006 |
| JP | 2008-44235 | 2/2008 |
| JP | 2009-196347 | 9/2009 |
| JP | 2011-62988 | 3/2011 |

* cited by examiner

IMAGE FORMATION DEVICE

RELATED APPLICATIONS

This is a U.S. National stage of International application No. PCT/JP2013/062643 filed on Apr. 30, 2013.

This patent application claims the priority of Japanese application no. 2012-104619 filed May 1, 2012, the disclosure content of which is hereby incorporated by reference.

TECHNICAL FIELD

The present invention relates to an image formation device that performs image formation on both sides of a recording medium.

BACKGROUND ART

Image formation using ink, such as inkjet recording, enables formation of high-definition images with a relatively simple configuration, and the range of its use is increasing.

Among such inkjet recording devices, an inkjet recording device is known that includes an image formation drum to convey a recording medium while the recording medium is lying along the outer periphery of the image formation drum, a supply part to supply a recording medium at a predetermined supply position on the image formation drum, heads to eject ultraviolet curable ink to a recording medium, which is being conveyed on the image formation drum, to perform image formation, a UV irradiating unit to irradiate with UV rays a recording medium on which image formation has been performed, and an output unit to receive a recording medium at a predetermined output position of the image formation drum and to output the recording medium to the outside of the device (See Patent Literature 1).

In recent years, such an image formation device that ejects ink for image formation while conveying a recording medium lying along the outer periphery of the image formation drum is required to have a function of image formation on both sides of recording media.

In order to perform image formation on both sides of recording media, a medium inversion mechanism may be provided. The medium inversion mechanism pulls a recording medium away from the image formation drum to turn over the recording medium after image formation has been performed on the front side of the recording medium, and then returns the turned-over recording medium to the image formation drum. Image formation is then performed on the back side of the turned-over recording medium. Image formation on both sides of the recording medium is thus achieved.

PRIOR ART LITERATURES

Patent Literatures

Patent Literature 1: Japanese Unexamined Patent Application Publication No. 2009-196347

DISCLOSURE OF INVENTION

Problems to be Solved by the Invention

In image formation using ink, such as inkjet recording involving ejection of liquid, proper temperature management of ink is required in many cases. In order to manage the temperature of ink before being ejected, it is only necessary to heat ink at the heads and maintain a proper temperature; whereas in order to ensure a proper temperature of ink drops that have been ejected on a recording medium, it is necessary to heat a recording medium or an image formation drum to maintain the proper temperature.

In the case of an image formation device that conveys a recording medium on the image formation drum, a proper temperature can be maintained more easily by heating the surface of the image formation drum than by heating a recording medium itself, which has only a small thickness and a small heat capacity. Accordingly, it is effective to heat the surface of the image formation drum when the surface of the image formation drum is not covered with a recording medium.

In the case of an image formation device that performs image formation on only the front side, the region from the output part to the supply part of the outer periphery of the image formation drum is not used to convey a recording medium. Thus a heater may be disposed over this region to heat the surface of the image formation drum.

In the case of an image formation device that performs image formation on both sides of a recording medium, on the other hand, a medium inversion mechanism to turn over a recording medium is expected to be disposed over the region from the output part to the supply part of the outer periphery of the image formation drum. In the case of an image formation device that performs image formation on both sides of a recording medium, therefore, there is a problem of the difficulty in placing a heater to heat the image formation drum.

An example case of using ultraviolet curable ink is shown above with reference to the prior art, but heating the surface of the image formation drum is required not only for such ultraviolet curable ink but also for any type of liquid ink in order to achieve a proper ink viscosity and to achieve drying and fixing after the image formation.

An object of the present invention is to allow temperature management by heating the surface of an image formation drum while performing image formation on both sides of a recording medium through inkjet recording.

Means for Solving Problems

The present invention is an image form device to eject ink to perform recording on a recording medium, the image form device including: an image formation drum which rotates in a predetermined direction to convey the recording medium held on an outer periphery of the image formation drum; a recording medium supplying unit which supplies the recording medium to the image formation drum at a predetermined supply position; a recording head including a plurality of nozzles to individually eject the ink onto the recording medium which has been supplied to the image formation drum, the nozzles being arranged in a direction perpendicular to a conveyance direction of the recording medium; and a conveying mechanism which receives the recording medium, onto which the ink has been ejected, from the image formation drum at a reception position downstream of the recording head in the conveyance direction, and conveys the recording medium selectively either to a paper output path for outputting the recording medium or to an inversion path for turning over the recording medium, wherein the conveying mechanism returns the turned-over recording medium to the image formation drum at a return position downstream of the reception position in the conveyance direction and upstream of the supply position in the conveyance direction; and a drum heater which heats a surface of the image formation drum is provided between the reception position and the return position.

Further, the ink may have a property of curing when irradiated with energy rays; and an energy-ray irradiator may be provided which irradiates the recording medium on the image formation drum with the energy rays at a position downstream of the recording head in the conveyance direction and and upstream of the reception position in the conveyance direction.

Further, an ink heater may be provided which heats the ink to be supplied to the recording head before the ink is ejected.

Further, the ink may have a property of changing phase depending on a temperature of the ink.

Further, the drum heater may heat the image formation drum by non-contact heating or may heat the image formation drum by contact heating.

Further, a medium heater may be provided which heats a recording surface of the recording medium at a position downstream of the supply position in the conveyance direction and and upstream of the recording head in the conveyance direction.

Effects of the Invention

At the time of image formation, the present invention heats an image formation drum with a drum heater, supplies a recording medium at a supply position on the image formation drum, and performs image formation on the front side of the recording medium with a recording head. A conveying mechanism receives the recording medium from the image formation drum at a reception position, turns over the recording medium in an inversion path, and returns the recording medium to the image formation drum at a return position. Image formation is then performed on the back side of the recording medium. After the conveying mechanism receives the recording medium from the image formation drum at the reception position, the recording medium is sent to a paper output path to be output. The image formation on both sides of the recording medium is thus completed.

With such a configuration, a recording medium does not exist in the region from the reception position to the return position, at which the conveying mechanism receives and returns the recording medium, respectively, on the outer periphery of the image formation drum at any time. The drum heater heats the image formation drum using this region. The image formation device for both-side image formation having such a configuration achieves efficient heating of the image formation drum with no recording medium between the drum heater and the drum.

The ink having the property of curing when irradiated with energy rays is often subject to effects of temperature. If the ink having such a curing property is used, the drum heater that enables a proper temperature of the image formation drum achieves excellent image formation with stable quality.

An ink heater to heat the ink to be supplied to a recording head enables a proper temperature of ink before being ejected and thereby enables the ink to be ejected at a proper viscosity. This configuration enables image formation with more stable quality and enhances the reliability of the recording head.

If the ink has the property of changing phase depending on its temperature, a proper temperature of the image formation drum leads to proper change in phase, enabling excellent image formation with more stable quality.

A medium heater to heat the recording surface of a recording medium eliminates the influence on the ejected ink by the temperature of the recording medium before being supplied, enabling excellent image formation with more stable quality.

EMBODIMENT TO CARRY OUT THE INVENTION

Outline of Image Formation Device

An image formation device 1, which is an embodiment of the present invention, will now be described in detail with reference to the drawings. The embodiment is an example of the present invention, and the invention is not limited to the embodiment.

Figure 1:
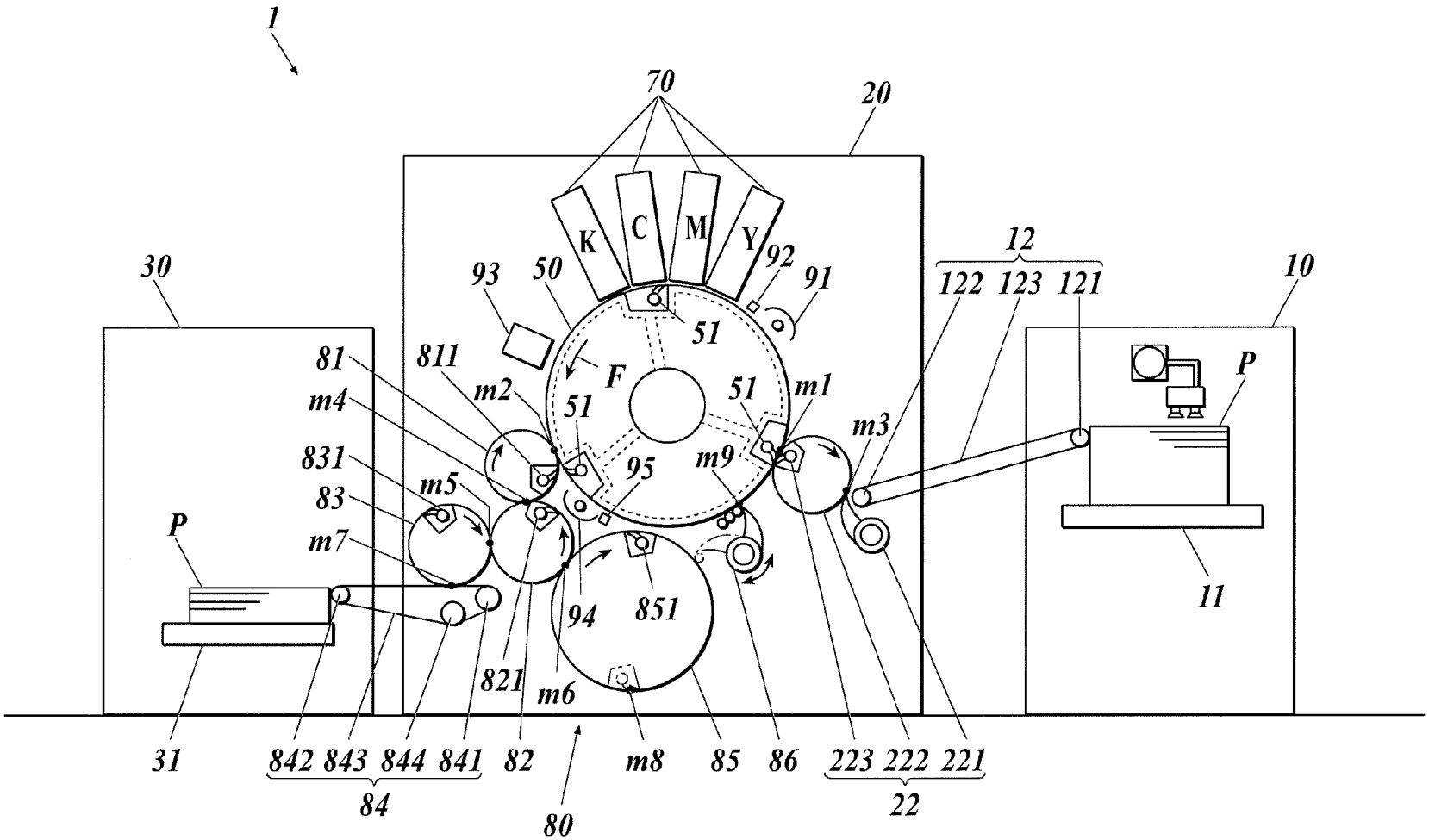
FIG. 1 is a diagram showing the main configuration of an image formation device, which is an embodiment of the present invention.

FIG. 1 is a diagram showing the main configuration of the image formation device 1, which is an embodiment of the present invention.

Figure 5:
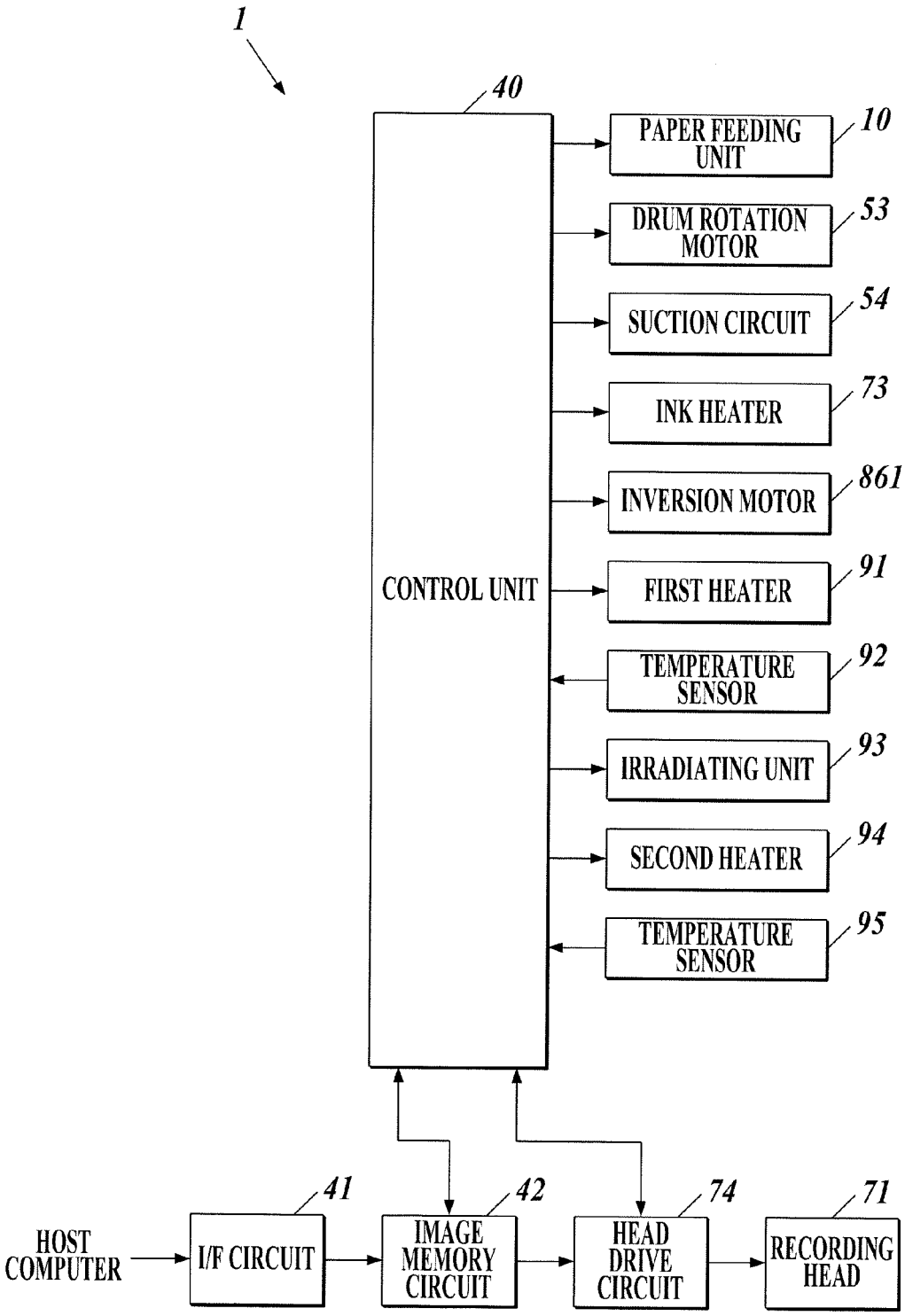
FIG. 5 is a block diagram showing the main control configuration of an image formation device 1.

The image formation device 1 includes a paper feeding unit 10, an image formation unit 20, a paper output unit 30, and a control unit 40 (see FIG. 5). The image formation device 1 conveys recording media P stored in the paper feeding unit 10 to the image formation unit 20, forms images on one side or both sides of the recording media P in the image formation unit 20, and outputs the recording media P, on which images have been formed, to the paper output unit 30, under the control of the control unit 40.

[Paper Feeding Unit]

The paper feeding unit 10 includes a paper feeding tray 11 to store recording media P, and a conveying unit 12 to convey recording media P from the paper feeding tray 11 to the image formation unit 20.

The paper feeding tray 11 is a plate member on which a stack of recording media P, which have been cut into a standardized size, can be placed. The paper feeding tray 11 moves up and down in accordance with the number of recording media P placed on the paper feeding tray 11, and is held at a position to allow the conveying unit 12 to convey the topmost recording medium P, with respect to the up-and-down motion direction.

The conveying unit 12 includes a conveying mechanism to drive a looped belt 123, whose inner face is supported by a plurality of (e.g., two) rollers 121 and 122, to convey recording media P on the belt 123; and a supplying unit (not shown) to deliver the topmost recording medium P, placed over the paper feeding tray 11, to the belt 123. The conveying unit 12 conveys a recording medium P, which has been delivered by the supplying unit to the belt 123, along the belt 123.

[Configuration of Image Formation Unit]

The image formation unit 20 includes an image formation drum 50 to hold a recording medium P on its cylindrical outer periphery; a delivering unit 22 to deliver a recording medium, which has been conveyed by the conveying unit 12 of the paper feeding unit 10, to the image formation drum 50; a first heater 91 as a medium heater which heats a recording medium P held on the image formation drum 50; head units 70 to eject ink onto a recording medium P held on the image formation drum 50 to form an image; a cleaning unit 60 (see FIG. 4) which receives ink ejected from the head units 70 at the time of maintenance of the head units 70; an irradiating unit 93 as an energy-ray irradiator which emits energy rays for curing ink ejected onto a recording medium P; a conveying mechanism 80 which receives a recording medium P, which has been irradiated by the irradiating unit 93, from the image formation drum 50 and selects and performs either conveying the received recording medium P to the paper output unit 30 or turning over the received recording medium P to return it to the image formation drum 50; and a second heater 94 as a drum heater which directly heats the outer periphery of the image formation drum 50 with no recording medium P between the second heater 94 and the drum 50.

[Image Formation Unit: Image Formation Drum]

Figure 2:
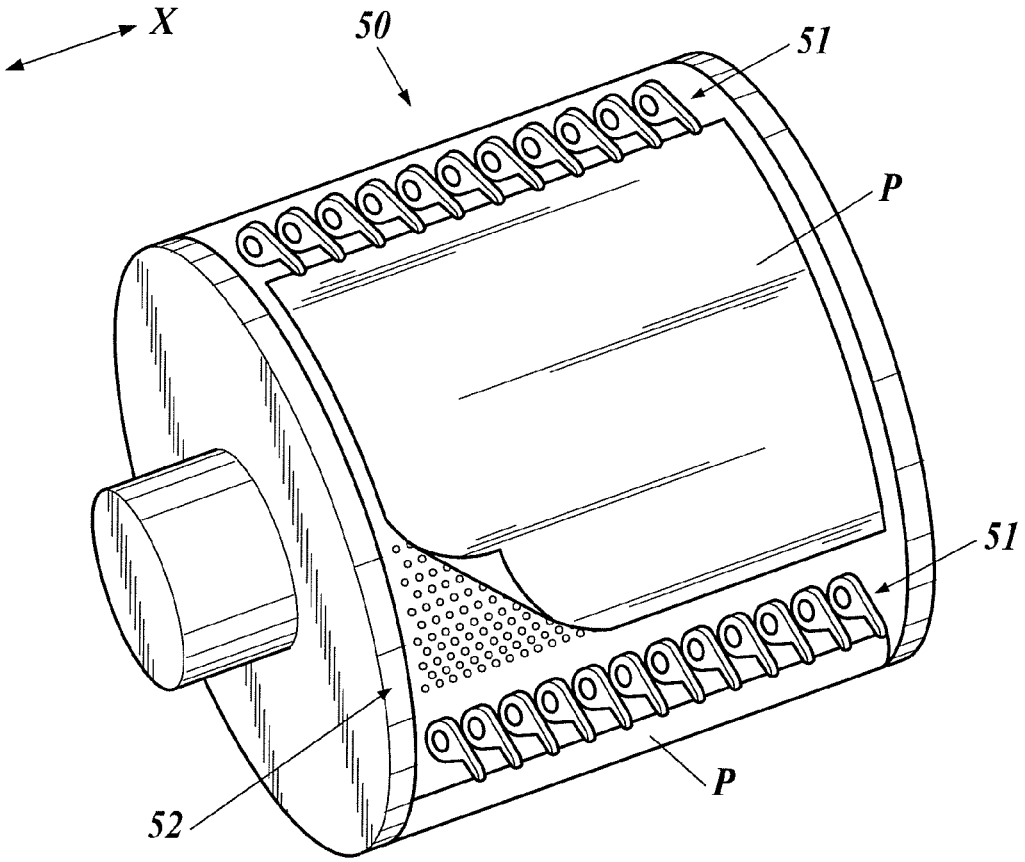
FIG. 2 is a perspective view of an image formation drum.

FIG. 2 is a perspective view of the image formation drum 50.

The image formation drum 50 includes nail parts 51 and a suction part 212 to hold a recording medium P on the outer periphery of the image formation drum 50. A drum rotation motor 53 (see FIG. 5) is provided to rotate the image formation drum 50 in a predetermined conveyance direction F (counterclockwise direction in FIG. 1).

The image formation drum 50 has three equal recording medium P holding areas, into which the outer periphery of the image formation drum 50 is divided. In other words, a maximum of three recording media P can be held on the image formation drum 50.

The nail parts 51 are disposed at the boundaries of the three recording medium P holding areas, i.e., disposed at intervals of 120° about the rotation axis of the image formation drum 50. Each of the three nail parts 51 includes a plurality of nails arranged in a row in the direction of the rotation axis (X direction) on the outer periphery of the cylindrical image formation drum 50.

The position at which a nail part 51 allows transfer of a recording medium P from the delivering unit 22 to the image formation drum 50 by the rotation of the image formation drum 50 is referred to as a supply position m1, and the position at which a nail part 51 allows transfer of a recording medium P from the image formation drum 50 to the conveying mechanism 80 is referred to as a reception position m2. The image formation drum 50 is provided with a cam mechanism (not shown) to provide an opening motion for the nails of the nail parts 51 to be released when the nail parts 51 come to the supply position m1 and the reception position m2.

Specifically, the nail parts 51 come to the supply position m1 with their nails open. When the nail parts 51 leave the supply position m1, the nail parts 51 close their nails to catch the end of a recording medium P. The nail parts 51 thus receive the recording medium P from the delivering unit 22 and start conveying the recording medium P.

When the nail parts 51 come to the reception position m2, the nails of the nail parts 51 are opened to release a recording medium P which has been conveyed. The nails are closed when the nail parts 51 leave the reception position m2, and then the empty holding area moves downstream.

The reception position m2 is equivalent to "reception position downstream of the recording head in the conveyance direction".

With reference to FIG. 2, the suction part 52 includes a plurality of suction holes and a suction generating part (e.g., an air pump, fan, or injector). The suction holes are disposed in the outer periphery of the image formation drum 50, on which a recording medium P is to lie while an end of the recording medium P is caught by a nail part 51. The suction generating part generates suction force to suck gas into the image formation drum 50 through the suction holes. Specifically, the suction part 52 allows a recording medium P to stick to the outer periphery of the image formation drum 50 so as to lie along the outer periphery with the suction force generated by suction through the suction holes.

The internal space of the image formation drum 50 is divided into three compartments corresponding to the three recording medium P holding areas, respectively. A suction circuit 54 (see FIG. 5) is provided that selects the suction part 52 for an individual holding area to give suction force to the selected holding area. This configuration can operate the suction part 52 not to give suction force to a holding area that is not holding a recording medium P, preventing the reduction of suction force of the suction part 52 for a holding area that is not holding a recording medium P. Such reduction of suction force would occur if the internal space of the image formation drum 50 is not divided into compartments.

In FIG. 2, a part of the recording medium P is turned up from the outer periphery of the image formation drum 50 for the purpose of showing the suction holes. In reality, however, an entire recording medium P is held on the outer periphery of the image formation drum 50 so as to lie along the outer periphery at the time of image formation by the image formation unit 20.

[Image Formation Unit: Delivering Unit]

The delivering unit 22 is disposed between the conveying unit 12 of the paper feeding unit 10 and the image formation drum 50. The delivering unit 22 includes a delivering nail part 221 to catch one end of a recording medium P which has been conveyed by the conveying unit 12, and a cylindrical delivering drum 222 to receive a recording medium P caught with the delivering nail part 221 and to deliver the received recording medium P to the image formation drum 50 at the supply position m1.

The delivering drum 222 has one nail part 223 to tightly hold one end of a recording medium P with the same structure as that of the nail parts 51 of the image formation drum 50. The delivering drum 222 is provided with a cam mechanism that opens and closes the multiple nails constituting the nail part 223 to allow the nails to receive and deliver a recording medium P.

The cam mechanism closes the nails of the nail part 223 to catch a recording medium when the nail part 223 comes to the transfer position m3 where the nail part 223 is close to and faces the delivering nail part 221. The cam mechanism opens the nails of the nail part 223 to allow a recording medium to be transferred to the image formation drum 50 when the nail part 223 comes to the supply position m1 where the nail part 223 is close to and faces a nail part 51 of the image formation drum 50.

A gear mechanism (not shown) allows the linkage of the delivering drum 222 and the image formation drum 50 in such a way that the rotation of the image formation drum 50 by one recording medium P holding area (i.e., 120°) makes a full revolution of the delivering drum 222 in the direction opposite to that of the image formation drum 50.

[Image Formation Unit: First Heater]

The first heater 91 is a lamp heater, such as a non-contact halogen lamp for infrared irradiation, and includes a reflector to reflect the light from the lamp heater to be orthogonal to the outer periphery of the image formation drum 50 uniformly, thereby efficiently irradiating and heating the outer periphery of the image formation drum 50.

The first heater 91 is disposed downstream of the supply position m1 in the conveyance direction and upstream of the head units 70 in the conveyance direction over the outer periphery of the image formation drum 50. In other words, the first heater 91 is provided to heat a recording medium P on the outer periphery of the image formation drum 50 before image formation.

A temperature sensor 92 to detect the temperature of a recording medium P held on the image formation drum 50 is disposed near the first heater 91 and downstream of the first heater 91 in the conveyance direction. A contact temperature detection element, such as a thermocouple and a thermistor, may be used as the temperature sensor 92, but a non-contact temperature detection element, such as a thermopile, is more preferable.

The control unit 40 controls the heating operation of the first heater 91 on the basis of the temperature detected by the temperature sensor 92 so that a recording medium P passing near the first heater 91 on the image formation drum 50 becomes a predetermined temperature.

[Image Formation Unit: Head Unit]

Figure 3A:
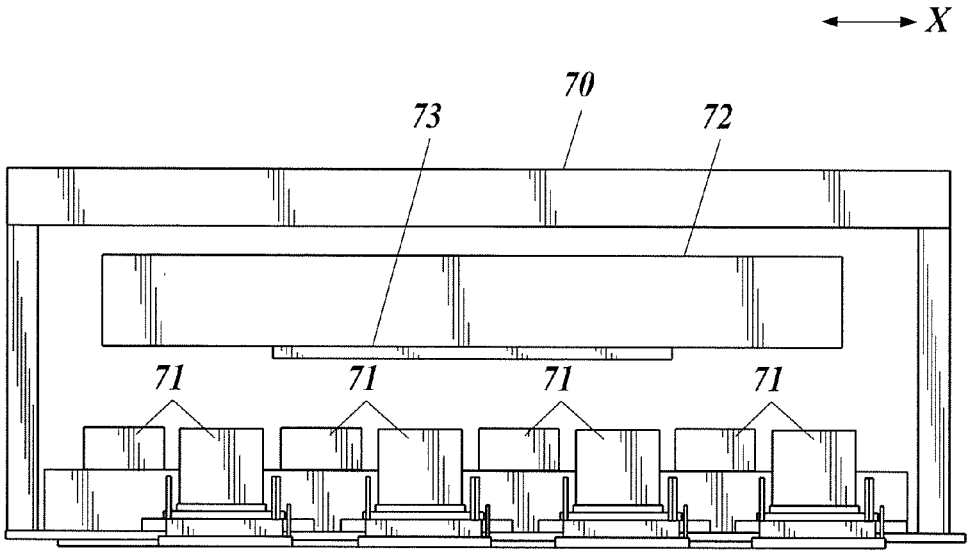
FIG. 3A is a schematic diagram of the internal configuration of a head unit viewed from the side.
Figure 3B:
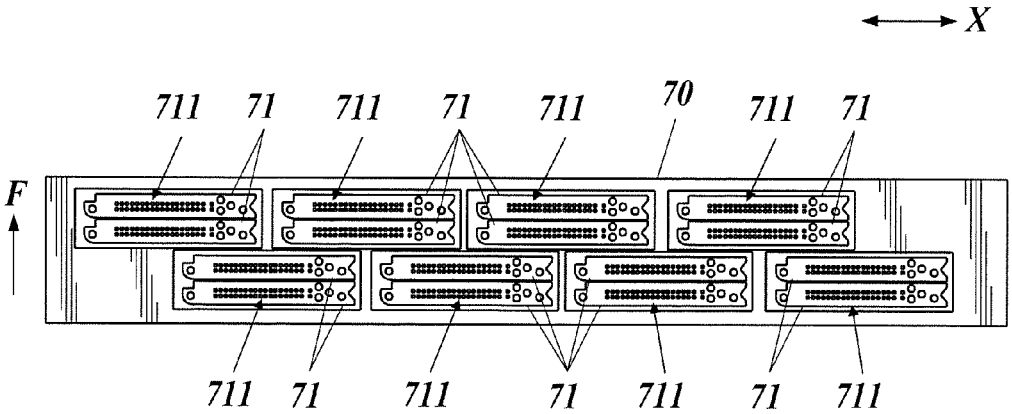
FIG. 3B is a schematic diagram of the internal configuration of a head unit viewed from above.

FIGS. 3A and 3B show the internal configuration of a head unit 70. FIG. 3A is a schematic diagram of the internal configuration, seen from the side, of the head unit 70; and FIG. 3B is a schematic diagram of the internal configuration, seen from the above, of the head unit 70. In connection with the term "above" used here, the side of one surface of the head unit 70 facing the outer periphery of the image formation drum 50 is "below the head unit 70". The case in which the head unit 70 is viewed from the side means the case in which the head unit 70 is viewed assuming that one lateral face along the top/bottom direction and the X direction of the head unit 70 is the front face.

Four head units 70 are arranged in the conveyance direction F in which the image formation drum 50 conveys a recording medium P. The head units 70 of yellow (Y), magenta (M), cyan (C), and black (K) are arranged in this order from the upstream side in the conveyance direction. Since the structures of the head units 70 of the colors are the same, only one head unit 70 is described here.

The head units 70 are disposed with their lower surfaces at a predetermined distance from the image formation drum 50 along the outer periphery of the image formation drum 50.

With reference to FIGS. 3 and 3B, each head unit 70 includes a plurality of recording heads 71, an ink tank 72 to store ink to be supplied to the recording heads 71, and an ink heater 73 to heat the ink before being ejected in ink paths (not shown) connecting the ink tank 72 and the recording heads 71 for temperature regulation of the ink.

Each of the recording heads 71 has a plurality of nozzles 711 arranged in the direction parallel to the rotation axis direction (i.e., X direction) of the image formation drum 50, that is, the direction perpendicular to the conveyance direction F of a recording medium P. The recording heads 71 eject ink individually through the nozzles 711 to form an image on a recording medium P held on the image formation drum 50. Specifically, the nozzles 711 of the recording heads 71 are exposed on the lower sides of the head units 70. The recording heads 71 shown in FIG. 3B each have a plurality of nozzles 711 arranged in such a way that two nozzle rows extend in the X direction.

With reference to FIG. 3B, for example, the recording heads 71 are arranged in pairs in such a way that the pairs of the recording heads 71 form a plurality of rows of the recording heads 71 extending in the X direction. The positional relationships of the pairs of the recording heads 71 in adjacent rows are such that the pairs are arranged in a staggered fashion in the direction perpendicular to the X direction (i.e., in the conveyance direction F).

The ink paths extending from the ink tank 72 to the recording heads 71 are provided with a mechanism for regulating the supply pressure which adjusts the supply pressure to be a little lower than atmospheric pressure to prevent the ink from dropping from the nozzles 711 of the recording heads 71.

A temperature sensor to detect the temperature of the ink to be supplied is provided for the ink heater 73. The control unit 40 controls the output of the ink heater 73 to achieve a proper temperature while monitoring the temperature of the ink to be supplied.

The head unit 70 is individually provided for each of the colors (YMCK) used for image formation, as described above. The image formation device 1 shown in FIG. 1 has the head units 70 for the colors of Y, M, C, and K, respectively, in this order from upstream in the conveyance direction in which a recording medium P is conveyed by the rotation of the image formation drum 50.

Figure 4:
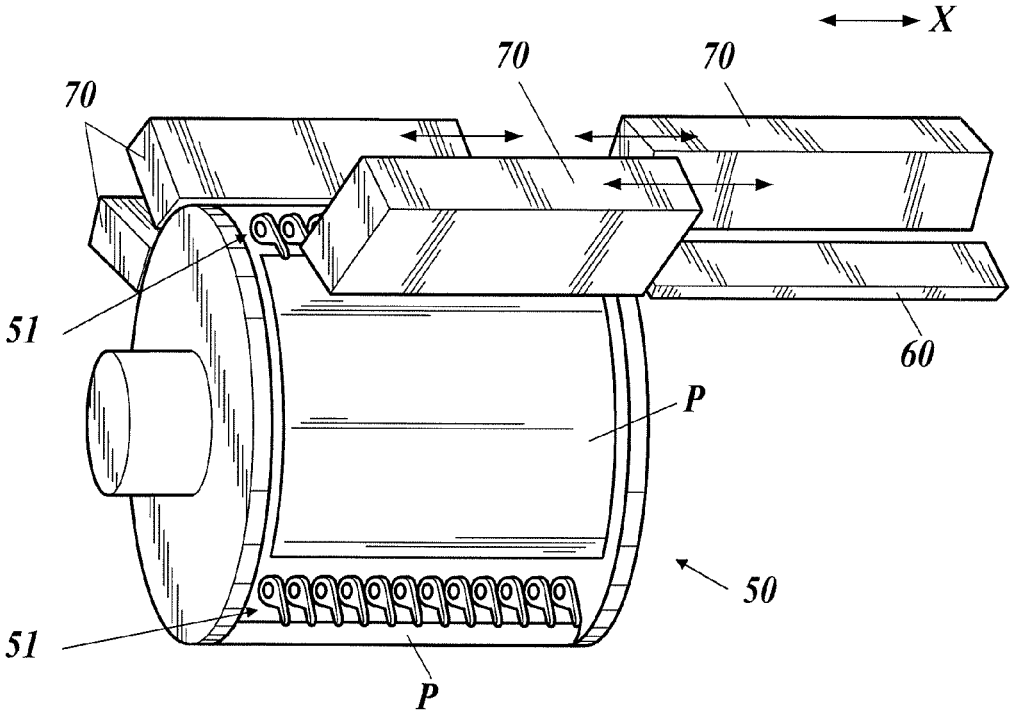
FIG. 4 is a perspective view showing the positional relationship between an image formation drum and a cleaning unit, and the positions of a head unit before and after being moved.

With reference to FIG. 4, each head unit 70 has an X-direction width wide enough to cover the X-direction width of a recording medium P to be held and conveyed by the image formation drum 50 (e.g., a width smaller than but close to the width of the image formation drum 50). At the time of image formation, the positions of the head units 70 are fixed relative to the image formation drum 50. In other words, the image formation device 1 is a single-pass inkjet recording device, where the number of all the nozzles 711 of the recording heads 71 arranged in the X direction on each head unit 70 corresponds to the width of an image to be formed on a recording medium P in the direction (i.e., X direction) perpendicular to the conveyance direction.

[Image Formation Unit: Cleaning Unit]

FIG. 4 is a perspective view showing the positional relationship between the image formation drum 50 and the cleaning unit 60, and showing the positions of a head unit 70 before and after being moved.

Each of the four head units 70 is supported in such a way as to be movable individually along the X direction in the image formation unit 20. Specifically, with reference to FIG. 4, each head unit 70 can move between the image formation drum 50 and the cleaning unit 60 disposed to be adjacent to each other in the X direction. The head unit 70 moves to the position such that the lower surface of the head unit 70 faces the image formation drum 50 at the time of image formation, and moves to the position such that the lower surface of the head unit 70 faces the cleaning unit 60 at the time of various kinds of maintenance, described later, under the control of the control unit 40.

The cleaning unit 60 includes a waste ink part (not shown) to receive and collect ink ejected from the head units 70 at the time of maintenance, thereby preventing the image formation unit 20 from being dirtied by the ink ejected from the head units 70 at the time of maintenance.

[Image Formation Unit: Irradiating Unit]

The irradiating unit 93 includes a lamp, such as a high-pressure mercury lamp. The lamp emits light to provide energy rays, such as ultraviolet rays. The irradiating unit 93 is disposed near the outer periphery of the image formation drum 50, downstream of the head units 70, and upstream of the conveying mechanism 80 in the conveyance direction F in which a recording medium P is conveyed by the rotation of the image formation drum 50. The irradiating unit 93 irradiates, with energy rays, a recording medium P which is held on the image formation drum 50 and on which ink has been ejected. The energy rays cure the ink on the recording medium P.

The lamp to emit ultraviolet rays is not limited to a high-pressure mercury lamp but may be a mercury lamp having an operating pressure from several hundred Pa to 1 MPa, a light source to be used as a germicidal lamp, a cold-cathode tube, an ultraviolet laser source, a metal halide lamp, and a light-emitting diode, for example. A light source which can emit ultraviolet rays at high intensity and consumes less power (e.g., a light-emitting diode) is preferred. The energy rays are not limited to ultraviolet rays but may be any other energy rays that have the property of curing ink according to the type of ink. A light source is replaced in accordance with energy rays.

[Image Formation Unit: Conveying Mechanism]

The conveying mechanism 80 includes a first conveyance drum 81 to receive a recording medium P from the image formation drum 50, a second conveyance drum 82 to receive a recording medium P from the first conveyance drum 81, a paper output drum 83 to receive a recording medium P from the second conveyance drum 82, a paper output belt mechanism 84 to receive a recording medium P from the paper output drum 83 to deliver the recording medium P to the paper output unit 30, an inversion drum 85 to receive a recording medium P from the second conveyance drum 82, and an inversion arm 86 to pull a recording medium P away from the inversion drum 85 and give the recording medium P to a nail part 51 of the image formation drum 50.

The first conveyance drum 81 has one nail part 811 to tightly hold one end of a recording medium P with the same structure as that of the nail parts 51 of the image formation drum 50. A cam mechanism is provided that opens and closes the multiple nails constituting the nail part 811 to allow the nails to receive and deliver a recording medium P when the nail part 811 of the first conveyance drum 81 is at the reception position m2 and the transfer position m4. The reception position m2 is the position at which a recording medium P is transferred from the formation drum 50 to the first conveyance drum 81. The transfer position m4 is the position at which a recording medium P is transferred from the first conveyance drum 81 to the second conveyance drum 82.

A gear mechanism (not shown) allows the linkage of the first conveyance drum 81 and the image formation drum 50 in such a way that the rotation of the image formation drum 50 by one recording medium P holding area (i.e., 120°) makes a full revolution of the first conveyance drum 81 in the direction opposite to that of the image formation drum 50.

The second conveyance drum 82 has one nail part 821 to tightly hold one end of a recording medium P with the same structure as that of the nail parts 51 of the image formation drum 50. A cam mechanism is provided that opens and closes the multiple nails constituting the nail part 821 to allow the nails to receive and deliver a recording medium P when the nail part 821 of the second conveyance drum 82 is at (1) the transfer position m4 at which a recording medium P is transferred from the first conveyance drum 81 to the second conveyance drum 82, (2) the transfer position m5 at which a recording medium P is transferred from the second conveyance drum 82 to the paper output drum 83, and (3) the transfer position m6 at which a recording medium P is transferred from the second conveyance drum 82 to the inversion drum 85. The cam mechanism can switch between two operation states under the control of the control unit 40, as described later.

A gear mechanism (not shown) allows the linkage of the first conveyance drum 81 and the second conveyance drum 82 in such a way that a full revolution of the first conveyance drum 81 makes a full revolution of the first conveyance drum 81 in the direction opposite to that of the first conveyance drum 81.

The image formation device 1 can select one of image formation on only the front side of a recording medium P and image formation on both of the front and back sides. When image formation on only the front side is performed in succession, a recording medium P is transferred from the second conveyance drum 82 to the paper output drum 83 each time to be output.

Specifically, when image formation on only the front side is performed, the control unit 40 controls an actuator to switch the operation of the cam mechanism so that the nail part 821 operates in the states of (1) and (2) described above. In the state of (3) described above, the nail part 821 operates with no recording medium P held.

When image formation on both of the front and back sides is performed in succession, the three recording medium holding areas of the image formation drum 50 alternately receive a recording medium P from the delivering unit 22. Accordingly, the second conveyance drum 82 alternately receives a recording medium P from the first conveyance drum 81 to deliver it to the inversion drum 85 and receives a recording medium P from the first conveyance drum 81 to deliver it to the paper output drum 83. Thus every other holding area of the recording medium holding areas on the image formation drum 50 is empty at the beginning of image formation, but the recording media P passing the inversion drum 85 and turned over are returned to the empty areas. Specifically, a recording medium P with its front side facing outward and a recording medium P with its back side facing outward are arranged alternately on the image formation drum 50. The recording medium P on which image formation has been performed with its back side facing outward is output, whereas the recording medium P on which image formation has been performed with its front side facing outward is turned over to be returned to the image formation drum 50.

Thus when image formation is performed on both sides of a recording medium P, the control unit 40 controls the actuator to switch the operation of the cam mechanism so that the nail part 821 operates (i.e., receives a recording medium P) at the transfer position m4 of (1) for every revolution; and the operation of the nail part 821 (i.e., release of a recording medium P) and the non-operation of the nail part 821 (i.e., holding of a recording medium P) at the transfer position m5 of (2) alternately occur on a revolution basis. The operation of the nail part 821 at the transfer position m6 of (3) (i.e., release of a recording medium P) is performed for every revolution, but a recording medium P is output once in every two revolutions at the transfer position m5. Thus a recording medium P is transferred to the inversion drum 85 at the transfer position m6 once in every two revolutions.

The paper output drum 83 has one nail part 831 to tightly hold one end of a recording medium P with the same structure as that of the nail parts 51 of the image formation drum 50. The paper output drum 83 is provided with a cam mechanism embedded therein that opens and closes the multiple nails constituting the nail part 831 to allow the nails to receive and deliver a recording medium P when the nail part 831 of the paper output drum 83 is at the transfer positions m5 and m7. The transfer position m5 is the position at which a recording medium P is transferred from the second conveyance drum 82 to the paper output drum 83 (i.e., a position close to and facing the nail part 821 of the second conveyance drum 82). The transfer position m7 is the position close to and facing the paper output belt mechanism 84. Specifically, the cam mechanism allows the nail part 831 to operate at the transfer position m5 to receive a recording medium P, and allows the nail part 831 to operate at the transfer position m7 to release a recording medium P.

A gear mechanism (not shown) allows the linkage of the second conveyance drum 82 and the paper output drum 83 in such a way that a full revolution of the second conveyance drum 82 makes a full revolution of the paper output drum 83 in the direction opposite to that of the second conveyance drum 82.

The paper output belt mechanism 84 is mainly constituted of two sprockets 841 and 842, a timing belt 843 stretched between the sprockets 841 and 842, and a tension roller 844 to give a tensile force to the timing belt 843. The paper output belt mechanism 84 conveys recording media P from the paper output drum 83 to the paper output unit 30.

The path of recording media P from the paper output drum 83 through the paper output belt mechanism 84 to the paper output unit 30 constitutes "paper output path".

The inversion drum 85 has one nail part 851 to tightly hold one end of a recording medium P with the same structure as that of the nail parts 51 of the image formation drum 50. A cam mechanism is provided that opens and closes the multiple nails constituting the nail part 851 to allow the nails to receive and deliver a recording medium P when the nail part 851 of the inversion drum 85 is at the transfer positions m6 and m8. The transfer position m6 is the position at which a recording medium P is transferred with the nail part 851 close to and facing the nail part 821 of the second conveyance drum 82. The transfer position m8 is the position at which a recording medium P is transferred to the inversion arm 86.

The inversion drum 85, which has a diameter about twice as large as the diameter of the second conveyance drum 82, is rotated by a later-described inversion motor 861 (see FIG. 5), which is an independent drive source.

The inversion arm 86 has a nail at its tip to catch an end of a recording medium P. The tip of the inversion arm 86 can swing between the position at which the tip of the inversion arm 86 is in contact with the outer periphery of the inversion drum 85 and the position at which the tip of the inversion arm 86 is in contact with the outer periphery of the image formation drum 50.

The transfer of a recording medium P from the inversion drum 85 to the inversion arm 86 is performed as follows: the nail part 851 of the inversion drum 85 conveying a recording medium P passes the position close to and facing the inversion arm 86; when the nail part 851 comes to the transfer position m8 at which the end, not held by the nail part 851, of the recording medium P (i.e., the end on the upstream side in the conveyance direction) is close to the inversion arm 86, the nail of the inversion arm 86 catches the end of the recording medium P (i.e., the end not held by the nail part 851); and at the same time, the nail part 851 releases the recording medium P with the cam mechanism.

The transfer of a recording medium P from the inversion arm 86 to the image formation drum 50 is performed as follows: the inversion arm 86 catching the end of a recording medium P swings to the return position m9, which is the position close to and facing a nail part 51 of the image formation drum 50, and then releases the end of the recording medium P.

The inversion drum 85 and the inversion arm 86 thus constitutes "inversion path" to turn over a recording medium.

The return position m9 is equivalent to "return position downstream of the reception position in the conveyance direction and upstream of the supply position in the conveyance direction".

Each of the first conveyance drum 81, the second conveyance drum 82, the paper output drum 83, and the paper output belt mechanism 84 of the conveying mechanism 80 rotates in conjunction with the image formation drum 50 with a gear mechanism (not shown); and the inversion arm 86 swings in conjunction with the image formation drum 50. Only the inversion drum 85 is rotated by the inversion motor 861 (see FIG. 5) because the length of a recording medium P in the conveyance direction varies depending on the size of the recording medium P. Specifically, when the inversion arm 86, which swings at the timing according to the rotation of the image formation drum 50, comes to the position for receiving a recording medium P from the inversion drum 85, the rotation speed needs to be controlled according to the size of the recording medium P so that the end, not held by the nail part 851, of the recording medium P reaches the position close to and facing the inversion arm 86. For this reason, the rotation speed of the inversion motor 861 is controlled independently of the rotation of the image formation drum 50.

[Image Formation Unit: Second Heater]

The second heater 94 is a lamp heater, such as a non-contact halogen lamp for infrared irradiation, and includes a reflector, having the same configuration as that of the first heater 91, to efficiently irradiate and heat the outer periphery of the image formation drum 50.

In the case of both-side image formation, the conveying mechanism 80 is required to pull a recording medium P away from the image formation drum 50 at the reception position m2 to turn over the recording medium P, and is required to return the recording medium P to the return position m9 of the image formation drum 50, to achieve the function of turning over recording media P. Accordingly, a recording medium P does not exist on the region from the reception position m2 to the return position m9 of the image formation drum 50 in the conveyance direction F. In the case of image formation on only the front side, a recording medium P is pulled away from the image formation drum 50 at the reception position m2 to be output. In this case, too, therefore, a recording medium P does not exist on the region from the reception position m2 to the return position m9 of the image formation drum 50 in the conveyance direction F.

The second heater 94 is disposed to face the region from the reception position m2 to the return position m9 of the image formation drum 50 in the conveyance direction F. Thus, the second heater 94 can heat the outer periphery of the image formation drum 50 without a recording medium P between the second heater 94 and the image formation drum 50 at any time.

A temperature sensor 95 to detect the temperature of the outer periphery of the image formation drum 50 is disposed near the second heater 94 and downstream of the second heater 94 in the conveyance direction. A contact temperature detection element, such as a thermocouple and a thermistor, may be used as the temperature sensor 95, but a non-contact temperature detection element, such as a thermopile, is more preferable.

The control unit 40 controls the heating operation of the second heater 94 on the basis of the temperature detected by the temperature sensor 95 so that the outer periphery of the image formation drum 50 passing near the second heater 94 becomes a predetermined temperature.

[Paper Output Unit]

The paper output unit 30 includes a plate paper output tray 31 on which recording media P sent from the image formation unit 20 by the conveying mechanism 80 are placed. Recording media P on which images have been formed are held in the paper output unit 30 until picked up by a user.

[Ink]

Inks used for image formation by the image formation device 1 will now be described.

The ink used in the present invention is an activating beam curable ink which is cured by being irradiated with energy rays (activating beams). The ink has the property of changing phase between gel or solid and liquid depending on the temperature of the ink.

The activating beam curable ink contains a gelling agent in an amount of 1 percent by mass or more but less than 10 percent by mass, and exhibits a reversible sol-gel phase transition depending on temperature. The term "so-gel phase transition" used in the present invention refers to a phenomenon in which a liquid state at an elevated temperature is transformed into a non-fluid gel state at a cooled temperature lower than or equal to a gelation temperature, and the non-fluid gel state is reversibly transformed into a liquid state at an elevated temperature higher than or equal to the solation temperature.

The term "gelation" used in the present invention refers to a solidified, semi-solidified, or thickened state accompanied by sharp increases in viscosity and elasticity; for example, a lamella structure, a polymer network formed by non-covalent bonds or hydrogen bonds, a polymer network formed by physical aggregation, and an aggregated structure composed of substances each immobilized by interactions between fine particles or between deposited fine crystals. The term "solation" refers to a liquid state in which the interactions formed during the gelation are released. The term "solation temperature" used in the present invention refers to an elevated temperature at which a gel ink is transformed into a sol state having fluidity. The term "gelation temperature" refers to a cooled temperature at which a sol ink is transformed into a gel state having reduced fluidity.

The activating beam curable ink, which exhibits such so-gel phase transition, is transformed into a liquid state at an elevated temperature, and thus can be ejected from recording heads. Upon recording using the activating beam curable ink at an elevated temperature, ink drops on a recording medium are spontaneously cooled and rapidly solidified by a temperature difference between the ink drops and the recording medium. This can prevents poor quality of an image due to integration of adjacent dots. Unfortunately, ink drops that are readily solidified may be isolated from each other to form a rough image. The roughness may lead to inhomogeneous gloss such as extremely low gloss and unnatural glitter. Vigorous investigation by the inventors found that the control of solidifying properties of ink drops, a gelation temperature of ink, and the temperature of a recording medium within the following range can prevent poor image quality due to integration of the ink drops, and can also achieve highly natural gloss on the image. Specifically, printing or image formation with the ink which contains a gelling agent in an amount ranging of 0.1 percent by mass or more but less than 10 percent by mass and has a viscosity of $10^2$ mPa·s or higher but lower than $10^5$ mPa·s at 25° C., under the control of the difference between the gelation temperature ($T_{gel}$) of ink with the gelling agent and the surface temperature ($T_s$) of the recording medium within the range of 5 to 15° C. can prevent integration of the ink drops and thus simultaneously achieve high image quality and natural gloss on an image. In this case, the temperature of the recording medium is controlled within the range of 42 to 48° C.

The inventors guess that such a phenomenon involves the following processes. When an ink drop ejected onto a recording medium is solidified before an adjacent ink drop is ejected, low gloss and unnatural glitter on an image are caused; whereas, when adjacent ink drops are solidified a certain time after the ink drops are ejected and integrated with each other, extremely poor image quality is caused due to overlap of the ink drops. Vigorous investigation by the inventors found that the control of viscosity of the ejected ink drops can prevent integration of ink drops and facilitate proper leveling of adjacent ink drops, which leads to natural gloss on an image.

Using the ink containing a gelling agent in an amount of 0.1 percent by mass or more but less than 10 percent by mass and exhibiting a viscosity of $10^2$ mPa·s or higher but lower than $10^5$ mPa·s at 25° C. allows the viscosity of the ink to be controlled within the temperature range of substrate. This control can simultaneously achieve high image quality and natural gloss on an image. Such a finding is based on the following assumption: the ink having viscosity lower than $10^2$ mPa·s at 25° C. cannot sufficiently prevent the integration of ink drops, and thus causes poor image quality within the above-described temperature range. The ink having viscosity of $10^5$ mPa·s or higher at 25° C. may exhibit high viscosity after gelation and cause a noticeable increase in viscosity during a cooling process. The viscosity of such an ink is barely controlled to an extent to be properly leveled within the above-described temperature range, which may reduce the gloss of an image. Contrarily, the ink of the present invention, which is transformed into a viscous gel having proper viscosity after gelation, can effectively inhibit the solidification of the dots, and thus achieve image quality exhibiting relatively natural gloss.

The term "homogeneous gloss" in the present invention does not define an absolute gloss, e.g., a specular reflection gloss at 60 degree. It, however, refers to entirely homogeneous gloss of an image (in particular, a solid image) without partially inhomogeneous gloss of the image, e.g., unnatural glitter, undesirable decreases in gloss, and stripe inconsistencies in gloss on the image, due to microscopic differences in gloss.

Use of the activating beam curable ink described in the present invention under the control of the difference between the gelation temperature ($T_{gel}$) of the ink and the surface temperature ($T_s$) of the recording medium within the range of 5 to 15° C. can prevent poor image quality, and achieve high image quality exhibiting high sharpness of fine lines in characters and natural gloss. To achieve higher image quality, the temperature of the recording medium is preferably controlled within the range of 5 to 10° C.

The composition of the activating beam curable ink used in the present invention will now be described in sequence.

[Ink: Gelling Agent]

The term "gelation" used in the present invention refers to a solidified, semi-solidified, or thickened state accompanied by sharp increases in viscosity and elasticity; for example, a lamella structure, a polymer network formed by non-covalent bonds or hydrogen bonds, a polymer network formed by physical aggregation, and an aggregate structure composed of substances each immobilized by interactions between fine particles or between deposited fine crystals.

Typical examples of gels include a thermoreversible gel and a non-thermoreversible gel. The thermoreversible gel is transformed into a fluid solution (also referred to as "sol") when heated, while it is reversibly transformed into gel when cooled. The non-thermoreversible gel is not reversibly transformed into a fluid solution when heated once it gelates. The gel of the present invention, which contains an oil gelling agent, is preferably a thermoreversible gel to prevent clogging of the heads.

The gelation temperature (phase transition temperature) of the activating beam curable ink of the present invention is preferably 40° C. or higher but lower than 100° C., and more preferably, 45° C. or higher but 70° C. or lower. Taking into account summer environmental conditions, an ink exhibiting a phase transition at a temperature of 40° C. or higher can be stably ejected from recording heads regardless of the environment temperature during printing or image formation. An ink exhibiting a phase transition at a temperature lower than 90° C. eliminates the need for heating of the image formation device 1 to an extremely high temperature, which can reduce load on the recording heads 71 of and the components of the ink supply system of the image formation device 1.

The term "gelation temperature" used in the present invention, which refers to a temperature at which a liquid is transformed into a gel state accompanied by a rapid change in viscosity, is a synonym of a "gel transition temperature", "gel dissolution temperature", "phase transition temperature", "sol-gel phase transition temperature", and "gelation point".

A gelation temperature of ink in the present invention is calculated from a viscosity curve and a viscoelasticity curve observed with, for example, a rheometer (e.g., a stress controlled rheometer having a cone-plate, PhysicaMCR, Anton Paar Ltd.). The viscosity curve is observed during a temperature change in a sol ink at an elevated temperature under a low shear rate, whereas the viscoelasticity curve is observed during a measurement of a temperature change dependent on dynamic viscoelasticity. One example technique to obtain a gelation temperature involves placing a small piece of iron sealed in a glass tube into a dilatometer. With the temperature varied, a temperature at which the piece of iron in the ink liquid stops free-falling is determined to be a phase transition point (J. Polym. Sci, 21, 57 (1956)). Another example technique involves placing an aluminum cylinder on an ink to be subjected to a temperature change for gelation. A temperature at which the aluminum cylinder begins free-falling is determined to be a gelation temperature (Nihon Reoroji Gakkaishi (Journal of the Society of Rheology, Japan), Vol. 17, 86(1989)). An example simple technique involves placing a specimen in a gel state on a heat plate to be heated. A temperature at which the shape of the specimen collapses is determined to be a gelation temperature. Such a gelation temperature (phase transition temperature) of an ink can be controlled depending on the type of the gelling agent, the amount of the added gelling agent, and the type of the activating beam curable monomer.

The ink applied to the present invention preferably has a viscosity of $10^2$ mPa·s or higher but lower than $10^5$ mPa·s at 25° C., and more preferably, of $10^3$ mPa·s or higher but lower than $10^4$ mPa·s. Ink having a viscosity of $10^2$ mPa·s or higher can prevent poor image quality due to the integration of dots, while ink having a viscosity of lower than $10^5$ mPa·s can be properly leveled after being ejected onto a recording medium under a controlled surface temperature of the recording medium, and thus can provide homogeneous gloss. The viscosity of the ink can be appropriately controlled depending on the type of the gelling agent, the amount of the added gelling agent, and the type of the activating beam curable monomer. The viscosity of the ink in the present invention is observed with a stress controlled rheometer including a cone-plate (PhysicaMCR, Anton Paar, Ltd.), at a shear rate of 11.7 $s^{-1}$.

The gelling agent contained in the ink used in the present invention may be composed of a high-molecular compound or low-molecular compound; however, the gelling agent is preferably composed of a low-molecular compound for a good inkjet ejection.

Non-limiting specific examples of the gelling agents which can be formulated in the ink according to the present invention are listed below.

Specific examples of high-molecular compounds preferably used in the present invention include fatty acids with inulin, such as inulin stearate; dextrins of fatty acids, such as dextrin palmitate and dextrin myristate (Rheopearl, available from Chiba Flour Milling Co., Ltd.); glyceryl behenate/eicosadioate; and polyglyceryl behenate/eicosadioate (Nom Coat, available from The Nisshin Oillio Group, Ltd.).

Examples of low-molecular compounds preferably used in the present invention include oil gelling agents having low molecular weight; amid compounds, such as N-lauroyl-L-glutamic acid dibutylamide and N-2-ethylhexanoyl-L-glutamic acid dibutylamide (available from Ajinomoto Fine-Techno Co., Inc.); dibenzylidene sorbitol compounds, such as 1,3:2,4-bis-O-benzylidene-D-glucitol (Gell All D available from New Japan Chemical Co., Ltd.); petroleum-derived waxes, such as paraffin wax, micro crystalline wax, and petrolatum; plant-derived waxes, such as candelilla wax, carnauba wax, rice wax, Japan wax, jojoba oil, jojoba solid wax, and jojoba ester; animal-derived waxes, such as beewax, lanolin, and spermaceti; mineral waxes, such as montan wax and hydrogenated wax; denatured waxes such as hardened castor oil and hardened castor oil derivatives, montan wax derivatives, paraffin wax derivatives, micro crystalline wax derivatives, and polyethylene wax derivatives; higher fatty acids, such as behenic acid, arachidic acid, stearic acid, palmitic acid, myristic acid, lauric acid, oleic acid, and erucic acid; higher alcohols such as a stearyl alcohol and behenyl alcohol; hydroxystearic acids, such as 12-hydroxystearic acid; derivatives of 12-hydroxystearic acid; fatty acid amides, such as a lauric acid amide, stearic acid amide, behenic acid amide, oleic acid amide, erucic acid amide, ricinoleic acid amide, and 12-hydroxystearic acid amide (for example, Nikka Amide from Nippon Kasei Chemical Co., Ltd, ITOWAX available from Itch Oil Chemicals Co., Ltd, and FATTYAMID available from Kao Corporation); N-substituted fatty acid amides, such as N-stearyl stearic acid amide, N-oleyl palmitic acid amide; special fatty acid amides, such as N,N'-ethylenebisstearylamide N,N'-ethylenebis(12-hydroxystearic amide), and N,N'-xylylene bisstearylamide; higher amines, such as dodecylamine, tetradecylamine, and octadecylamine; fatty acid esters, such as stearyl stearate, oleyl palmitate, glycerin fatty acid ester, sorbitan fatty acid ester, propylene glycol fatty acid ester, ethylene glycol fatty acid ester, and polyoxyethylene fatty acid ester (e.g., EMALLEX available from Nihon Emulsion Co., Ltd., Rikemal available from Riken Vitamin Co., Ltd., and Poem available from Riken Vitamin Co., Ltd.); sucrose fatty acid esters, such as sucrose stearate and sucrose palmitate (for example, Ryoto Sugar Ester available from Mitsubishi-Kagaku Foods Corporation); synthetic waxes, such as polyethylene wax and α-olefin maleic anhydride copolymer wax; polymerizable waxes (UNILIN from Baker-Petrolite Corporation); dimer acids and dimer diols (PRIPOR available from Croda International Plc); which are described in Japanese Unexamined Patent Application Publication Nos. 2005-126507, 2005-255821, and 2010-111790. These gelling agents may be used alone or in combination as appropriate.

The ink used in the present invention, which contains the gelling agent, is transformed into a gel state immediately after being ejected from a recording head 71 onto a recording medium. This prevents the mixing and integration of dots and thus can provide high quality image during high-speed printing or image formation. The ink dots are then cured by activating beams to be fixed on the recording medium, forming a firm image film. The amount of the gelling agent included in the ink is preferably 1 percent by mass or more but less than 10 percent by mass, and more preferably, 2 percent by mass or more but less than 7 percent by mass. The ink containing the gelling agent in an amount of 1 percent by mass or more can be subjected to sufficient gelation and thus can prevent poor image quality due to the integration of the dots. Moreover, the ink drops having an increased viscosity after gelation decrease photocurable properties due to oxygen inhibition when the ink is photo-radically cured. The ink containing the gelling agent of less than 10 percent by mass can prevent poor quality of a cured film due to non-cured component after irradiation with activating beams and can prevent poor inkjet ejection characteristics.

[Ink: Activating Beam-Curable Compositions]

The ink of the present invention contains a gelling agent, coloring material, and an activating beam curable composition to be cured by activating beams.

The activating beam curable composition (hereinafter also referred to as "photopolymerizable compound") used in the present invention will now be described.

Examples of the activating beams used in the present invention include electron beams, ultraviolet rays, α beams, γ beams, and x-rays; however, ultraviolet rays and electron beams are preferred that are less damaging the human body, easy to handle, and industrially widespread. In the present invention, ultraviolet rays are particularly preferred.

In the present invention, any photopolymerizable compound that can be cross-linked or polymerized by irradiation with activating beams may be used without limitation; and, photo-cationically or photo-radically polymerizable compounds are preferred.

[Ink: Cationically Polymerizable Compound]

Any known cationically polymerizable monomers may be used as photo-cationically polymerizable monomers; examples of the cationically polymerized monomers include epoxy compounds, vinyl ether compounds, and oxetane compounds described in Japanese Unexamined Patent Application Publication Nos. 6-9714, 2001-31892, 2001-40068, 2001-55507, 2001-310938, 2001-310937, and 2001-220526.

In the present invention, the photopolymerizable compound preferably contains at least one oxetane compound and at least one compound selected from an epoxy compound and a vinyl ether compound in order to prevent contraction of the recording medium during curing of the ink.

Preferred examples of aromatic epoxides include di- or poly-glycidyl ethers prepared by the reaction of polyhydric phenol having at least one aromatic nucleus or an alkylene oxide adduct thereof with epichlorohydrin, such as diglycidyl or polyglycidyl ethers of bisphenol A or an alkylene oxide adduct thereof, diglycidyl or polyglycidyl ethers of hydrogenated bisphenol A or an alkylene oxide adduct thereof, and novolac epoxy resin. Examples of the alkylene oxides include ethylene oxide and propylene oxide.

Preferred examples of alicyclic epoxides include a cyclohexene oxide-containing compound and a cyclopentane oxide-containing compound that are prepared by epoxidizing a compound having at least one cycloalkane ring such as a cyclohexene ring and a cyclopentene ring with a proper oxidant, such as hydrogen peroxide and a peracid.

Preferred examples of aliphatic epoxides include diglycidyl or polyglycidyl ethers of aliphatic polyhydric alcohols or alkylene oxide adducts thereof. Representative examples of the diglycidyl or polyglycidyl ethers include diglycidyl ethers of alkylene glycols, such as diglycidyl ether of ethylene glycol, diglycidyl ether of propylene glycol, and diglycidyl ether of 1,6-hexanediol; polyglycidyl ethers of polyhydric alcohols, such as diglycidyl ether or triglycidyl ether of glycerine or alkylene oxide adducts thereof; and diglycidyl ethers of polyalkylene glycols, such as diglycidyl ethers of polyethylene glycol or alkylene oxide adducts thereof, and diglycidyl ethers of polypropylene glycol or alkylene oxide adducts thereof. Examples of the alkylene oxides include ethylene oxide and propylene oxide.

Preferred epoxides among these epoxides are aromatic epoxides and alicyclic epoxides, and more preferred are alicyclic epoxides because of their rapid curability. In the present invention, the above-described epoxides may be used alone or in combination as appropriate.

Examples of vinyl ether compounds include di- or tri-vinyl ether compounds, such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexane dimethanol divinyl ether, and trimethylolpropane trivinyl ether; and monovinyl ether compounds, such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexane dimethanol monovinyl ether, n-propyl vinyl ether, isopropyl vinyl ether, isopropenyl ether o-propylenecarbonate, dodecyl vinyl ether; diethylene glycol monovinyl ether, and octadecyl vinyl ether.

Preferred vinyl ether compounds among these vinyl ether compounds are di- or tri-vinyl ether compounds, and more preferred are di-vinyl ether compounds because of their curing properties, adhesion, and surface hardness. In the present invention, the above-described vinyl ether compounds may be used alone or in combination as appropriate.

The term "oxetane compound" used in the present invention refers to a compound having one or more oxetane rings. Any known oxetane compound may be used, for example, described in Japanese Unexamined Patent Application Publication Nos. 2001-220526 and 2001-310937.

The use of an oxetane compound having five or more oxetane rings in the present invention may lead to an increase in viscosity of the ink composition. Such an ink composition is hard to handle, has a high glass transition temperature, and thus exhibits low adhesion after curing. The oxetane compound used in the present invention thus is preferably a compound having one to four oxetane rings.

Example of the oxetane compounds preferably used in the present invention include compounds represented by Formulae (1), (2), (7), (8), and (9) respectively described in paragraphs [0089], [0092], [0107], [0109], and [0166] of Japanese Unexamined Patent Application Publication No. 2005-255821.

Specific examples of the oxetane compounds include example compounds 1 to 6 described in paragraphs [0104] to [0119], and compounds described in paragraph [0121] of Japanese Unexamined Patent Application Publication No. 2005-255821.

[Ink: Radically Polymerizable Compound]

A radically polymerizable compound will now be described.

Any known radically polymerizable monomers may be used as photo-radically polymerizable monomers. Example of the known radically polymerizable monomers include photo-curable material prepared using photo-polymerizable compounds, and cationically polymerizable photo-curable resin, which are described in Japanese Unexamined Patent Application Publication No. 7-159983, Japanese Examined Patent Application Publication No. 7-31399, and Japanese Unexamined Patent Application Publication Nos. 8-224982 and 10-863. In addition to these monomers, photo-cationically polymerizable photo-curable resin that is sensitized to light having wavelengths longer than those of visible light may also be used, the resin being described in Japanese Unexamined Patent Application Publication Nos. 6-43633 and No. 8-324137, for example.

Radically polymerizable compounds have radically polymerizable ethylenically unsaturated bonds. Any radically polymerizable compound that has at least one radically polymerizable ethylenically unsaturated bond in a molecule may be used that has a chemical form such as a monomer, oligomer, or polymer. Such radically polymerizable compounds may be used alone or in combination in any proportion to improve target properties.

Examples of the compounds having the radically polymerizable ethylenically unsaturated bond(s) include unsaturated carboxylic acids, such as acrylic acid, methacrylic acid, itaconic acid, crotonic acid, isocrotonic acid, and maleic acid, and salts, esters, urethanes, amides, anhydrides thereof; acrylonitrile; styrene; and radically polymerizable compounds such as various unsaturated polyesters, unsaturated polyethers, unsaturated polyamides, and unsaturated urethanes.

Any known (meth)acrylate monomers and/or oligomers may be used as radically polymerizable compounds for the present invention. The term "and/or" used in the present invention means that the radically polymerizable compound may be a monomer, oligomer, or combination thereof. The same is applied to the term "and/or" in the following description.

Example compounds having (meth)acrylate groups include monofunctional monomers, such as isoamyl acrylate, stearyl acrylate, lauryl acrylate, octyl acrylate, decyl acrylate, isomyristyl acrylate, isostearyl acrylate, 2-ethylhexyl diglycol acrylate, 2-hydroxybutyl acrylate, 2-acryloyloxyethyl hexahydrophthalate, butoxyethyl acrylate, ethoxydiethylene glycolacrylate, methoxydiethylene glycolacrylate, methoxypolyethylene glycolacrylate, methoxypropylene glycolacrylate, phenoxyethyl acrylate, tetrahydrofurfuryl acrylate, isobornyl acrylate, 2-hydroxyethyl acrylate, 2-hydroxypropyl acrylate, 2-hydroxy 3-phenoxypropyl acrylate, 2-acryloyloxy ethylsuccinic acid, 2-acryloyloxyethylphthalic acid, 2-acryloyloxyethyl 2-hydroxyethylphthalate, lactone modified flexible acrylate, and t-butylcyclohexyl acrylate; bifunctional monomers, such as triethylene glycol diacrylate, tetraethylene glycol diacrylate, polyethylene glycol diacrylate, tripropylene glycol diacrylate, polypropylene glycol diacrylate, 1,4-butanediol diacrylate, 1,6-hexanediol diacrylate, 1,9-nonanediol diacrylate, neopentyl glycol diacrylate, dimethylol tricyclodecane diacrylate, bisphenol-A PO-adduct diacrylate, hydroxypivalate neopentyl glycol diacrylate, and polytetramethylene glycol diacrylate; and multifunctional (tri- or higher functional) monomers, such as trimethylolpropane triacrylate, pentaerythritol triacrylate, pentaerythritol tetraacrylate, dipentaerythritol hexaacrylate, ditrimethylolpropane tetraacrylate, glycerine propoxy triacrylate, caprolactone-modified trimethylolpropane triacrylate, pentaerythritol ethoxy tetraacrylate, and caprolactam-modified dipentaerythritol hexaacrylate. In addition to these monomers, polymerizable oligomers may be used as well. Examples of the polymerizable oligomers include epoxy acrylates, aliphatic urethane acrylates, aromatic urethane acrylates, polyester acrylates, linear acylic oligomers. More specifically, commercially available or industrially known monomers, oligomers, and polymers that can be radically polymerized and crosslinked may be used, which are described in "Kakyozai Handobukku (Cross-linker Handbook)", Shinzo Yamashita (Taiseisha, 1981); "UV•EB Kouka Handobukku (Genryo Hen) (UV•EB Curing Handbook (Material))", Kiyomi Kato, (Koubunshi Kankoukai, 185); "UV•EB Koukagijyutsu no Ouyo to Shijyo (Application and Market of UV•EB Curing Technology)", pp. 79, RadTech Japan (CMC Publishing Co., Ltd., 1989); "Poriesuteru Jyushi Handbook (Polyester Resin Handbook)", Eiichiro Takiyama, (Nikkan Kogyo Shimbun Ltd., 1988).

Specific examples of the preferred monomers include isoamyl acrylate, stearyl acrylate, lauryl acrylate, octyl acrylate, decyl acrylate, isomyristyl acrylate, isostearyl acrylate, ethoxydiethylene glycol acrylate, methoxypolyethylene glycol acrylate, methoxypropylene glycol acrylate, isobornyl acrylate, lactone-modified flexible acrylate, tetraethylene glycol diacrylate, polyethylene glycol diacrylate, polypropylene glycol diacrylate, dipentaerythritol hexaacrylate, di(trimethylolpropane) tetraacrylate, glycerine propoxy triacrylate, caprolactone-modified trimethylolpropane triacrylate, pentaerythritol ethoxy tetraacrylate, and caprolactam-modified dipentaerythritol hexaacrylate in the light of their sensitivity, skin irritancy, eye irritancy, mutagenicity, and toxicity.

Specifically, more preferred monomers among these monomers are stearyl acrylate, lauryl acrylate, isostearyl acrylate, ethoxydiethylene glycol acrylate, isobornyl acrylate, tetraethylene glycol diacrylate, glyceryl propoxy triacrylate, caprolactone-modified trimethylolpropane triacrylate, and caprolactam-modified dipentaerythritol hexaacrylate.

The polymerizable compound of the present invention may be combinations of vinyl ether monomer and/or oligomer and (meth)acrylate monomer and/or oligomer. Examples of the vinyl ether monomers include di- or tri-vinyl ether compounds, such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexane dimethanol divinyl ether, and trimethylolpropane trivinyl ether; and monovinyl ether compounds, such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexane dimethanol monovinyl ether, n-propyl vinyl ether, isopropyl vinyl ether, isopropenyl ether o-propylene carbonate, dodecyl vinyl ether, diethylene glycol monovinyl ether, and octadecyl vinyl ether. The vinyl ether oligomer is preferably a bifunctional vinyl ether compound having a molar weight of 300-1000 and two to three ester groups in a molecule. Non-limiting examples of such bifunctional vinyl ether compounds include VEctomer available from Sigma-Aldrich Co. LLC., such as VEctomer 4010, VEctomer 4020, VEctomer 4040, VEctomer 4060, and VEctomer 5015.

The polymerizable compound of the present invention may be combinations of various vinyl ether compounds and maleimide compounds. Non-limiting examples of the maleimide compounds include N-methylmaleimide, N-propylmaleimide, N-hexylmaleimide, N-laurylmaleimide, N-cyclohexylmaleimide, N-phenylmaleimide, N,N'-methylenebismaleimide, polypropylene glycol bis(3-maleimidepropyl) ether, tetraethylene glycol bis(3-maleimidepropyl) ether, bis(2-maleimide ethyl) carbonate, N,N'-(4,4'-diphenylmethane) bismaleimide, N,N'-2,4-tolylene bismaleimide, and multifunctional maleimide compounds which are ester compounds containing maleimide carboxylic acids and various polyols, the multifunctional maleimide compound being described in Japanese Unexamined Patent Application Publication No. 11-124403.

The amount of added cationic polymerizable compound or radically polymerizable compound described above is preferably within a range of 1 to 97 percent by mass, and more preferably, of 30 to 95 percent by mass.

[Components of Ink]

Components, other than the components described above, of the ink of the present invention will now be described.

[Components of Ink: Color Material]

The ink of the present invention may contain any dye or pigment as a color material. The preferred materials are pigments with stable dispersion in the ink components and weatherability. Examples of pigments according to the invention include, but not limited to, organic and inorganic pigments represented by the following color index numbers, which can be used in accordance with the purpose.

Red or magenta pigments: Pigment Reds 3, 5, 19, 22, 31, 38, 43, 48:1, 48:2, 48:3, 48:4, 48:5, 49:1, 53:1, 57:1, 57:2, 58:4, 63:1, 81, 81:1, 81:2, 81:3, 81:4, 88, 104, 108, 112, 122, 123, 144, 146, 149, 166, 168, 169, 170, 177, 178, 179, 184, 185, 208, 216, 226, and 257; Pigment Violets 3, 19, 23, 29, 30, 37, 50, and 88; and Pigment Oranges 13, 16, 20, and 36.

Blue or cyan pigments: Pigment Blues 1, 15, 15:1, 15:2, 15:3, 15:4, 15:6, 16, 17-1, 22, 27, 28, 29, 36, and 60.

Green pigments: Pigment Greens 7, 26, 36, and 50.

Yellow pigments: Pigment Yellows 1, 3, 12, 13, 14, 17, 34, 35, 37, 55, 74, 81, 83, 93, 94, 95, 97, 108, 109, 110, 137, 138, 139, 153, 154, 155, 157, 166, 167, 168, 180, 185, and 193.

Black pigments: Pigment Blacks 7, 28, and 26.

Specific examples of the pigments include CHROMOFINE YELLOWs 2080, 5900, 5930, AF-1300, and AF-2700L; CHROMOFINE ORANGEs 3700L and 6730; CHROMOFINE SCARLET 6750; CHROMOFINE MAGENTAs 6880, 6886, 6891N, 6790, and 6887; CHROMOFINE VIOLET RE; CHROMOFINE REDs 6820 and 6830; CHROMOFINE BLUEs HS-3, 5187, 5108, 5197, 5085N, SR-5020, 5026, 5050, 4920, 4927, 4937, 4824, 4933GN-EP, 4940, 4973, 5205, 5208, 5214, 5221, and 5000P; CHROMOFINE GREENs 2GN, 2GO, 2G-550D, 5310, 5370, and 6830; CHROMOFINE BLACK A-1103; SEIKAFAST YELLOWs 10GH, A-3, 2035, 2054, 2200, 2270, 2300, 2400(B), 2500, 2600, ZAY-260, 2700(B), and 2770; SEIKAFAST REDs 8040, C405(F), CA120, LR-116, 1531B, 8060R, 1547, ZAW-262, 1537B, GY, 4R-4016, 3820, 3891, and ZA-215; SEIKAFAST CARMINES 6B1476T-7, 1483LT, 3840, and 3870; SEIKAFAST BORDEAUX 10B-430; SEIKALIGHT ROSE R40; SEIKALIGHT VIOLETs B800 and 7805; SEIKAFAST MAROON 460N; SEIKAFAST ORANGEs 900 and 2900; SEIKALIGHT BLUEs C718 and A612; CYANINE BLUEs 4933M, 4933GN-EP, 4940, and 4973 (Dainichiseika Color & Chemicals Mfg. Co., Ltd.); KET Yellows 401, 402, 403, 404, 405, 406, 416, and 424; KET Orange 501; KET Reds 301, 302, 303, 304, 305, 306, 307, 308, 309, 310, 336, 337, 338, and 346; KET Blues 101, 102, 103, 104, 105, 106, 111, 118, and 124; KET Green 201 (DIC Corporation), Colortex Yellows 301, 314, 315, 316, P-624, 314, U10GN, U3GN, UNN, UA-414, and U263; Finecol Yellows T-13 and T-05; Pigment Yellow 1705; Colortex Orange 202, Colortex Reds 101, 103, 115, 116, D3B, P-625, 102, H-1024, 105C, UFN, UCN, UBN, U3BN, URN, UGN, UG276, U456, U457, 105C, and USN; Colortex Maroon 601; Colortex Brown B610N; Colortex Violet 600; Pigment Red 122; Colortex Blues 516, 517, 518, 519, A818, P-908, and 510; Colortex Greens 402 and 403; Colortex Blacks 702 and U905 (Sanyo Color Works. LTD.); Lionol Yellow 1405G; Lionol Blues FG7330, FG7350, FG7400G, FG7405G, ES, and ESP-S (Toyo Ink SC Holdings Co., Ltd.); Toner Magenta E02; Permanent Rubin F6B; Toner Yellow HG; Permanent Yellow GG-02; Hostaperm Blue B2G (Hoechst Industry Ltd.); Novoperm P-HG; Hostaperm Pink E; Hostaperm Blue B2G (Clariant International Ltd.); and Carbon Blacks #2600, #2400, #2350, #2200, #1000, #990, #980, #970, #960, #950, #850, MCF88, #750, #650, MA600, MA7, MA8, MA11, MA100, MA100R, MA77, #52, #50, #47, #45, #45L, #40, #33, #32, #30, #25, #20, #10, #5, #44, and CF9 (Mitsubishi Chemical Corporation).

The pigments may be dispersed, for example, with a ball mill, a sand mill, an attritor, a roll mill, an agitator, a Henschel mixer, a colloid mill, an ultrasonic homogenizer, a pearl mill, a wet jet mill, or a paint shaker.

A dispersant may be added for dispersion of the pigments. The preferred dispersant is a polymer dispersant. Examples of polymer dispersants include Solsperse® series by Avecia Inc., PB series by Ajinomoto Fine-Techno Co., Inc., and the following materials.

Pigment dispersants: hydroxyl-containing carboxylic acid esters, salts of long-chain polyaminoamides and high-molecular-weight acid esters, salts of high-molecular-weight polycarboxylic acids, salts of long-chain polyaminoamides and polar acid esters, high-molecular-weight unsaturated acid esters, copolymers, modified polyurethanes, modified polyacrylates, polyether-ester anionic surfactants, salts of naphthalenesulfonic acid-formalin condensates, salts of aromatic sulfonic acid-formalin condensates, polyoxyethylene alkyl phosphate esters, polyoxyethylene nonylphenyl ethers, stearylamine acetates, and pigment derivatives.

Specific examples include: ANTI-TERRA-U (polyaminoamide phosphate salt), ANTI-TERRA-203 and ANTI-TERRA-204 (high-molecular-weight polycarboxylates), DISPERBYK-101 (polyaminoamide phosphate and acid ester), DISPERBYK-107 (hydroxyl group-containing carboxylic acid ester), DISPERBYK-110 (copolymer containing acid group), DISPERBYK-130 (polyamide), DISPERBYK-161, -162, -163, -164, -165, -166, and -170 (high-molecular-weight copolymers), 400, Bykumen (high-molecular-weight unsaturated acid ester), BYK-P104 and BYK-P105 (high-molecular-weight unsaturated polycarboxylic acids), BYK-P104S and -P240S (high-molecular-weight unsaturated polycarboxylic acids and silicon), and Lactimon (long-chain amine, unsaturated polycarboxylic acid, and silicon) by BYK-Chemie GmbH.

Further examples include: Efkas 44, 46, 47, 48, 49, 54, 63, 64, 65, 66, 71, 701, 764, and 766, Efka Polymers 100 (modified polyacrylate), 150 (aliphatic modified polymer), 400, 401, 402, 403, 450, 451, 452, 453 (modified polyacrylates), and 745 (copper phthalocyanine) by Efka Chemicals B.V.; FLOWREN TG-710 (urethane oligomer), FLOWNONs SH-290 and SP-1000, POLYFLOW Nos. 50E and 300 (acrylic copolymers) by Kyoeisha Chemical Co., Ltd.; Disparlons KS-860, 873SN, and 874 (polymer dispersants), and Disparlon #2150 (aliphatic polyvalent carboxylic acid) and #7004 (polyether ester) by Kusumoto Chemicals, Ltd.

Still further examples include: DEMOLs RN, N (sodium naphthalene sulfonate-formaldehyde condensates), MS, C, SN-B (sodium aromatic sulfonate-formaldehyde condensates), and EP, HOMOGENOL L-18 (polycarboxylic polymer), EMULGENs 920, 930, 931, 935, 950, and 985 (polyoxyethylene nonylphenyl ethers), ACETAMINs 24 (coconut amine acetate), and 86 (stearyl amine acetate) by Kao Corporation; SOLSPERSEs 5000 (phthalocyanine ammonium salt), 13240, 13940 (polyester amines), 17000 (aliphatic amine), 24000, and 32000 by AstraZeneca plc; and NIKKOL T106 (polyoxyethylene sorbitan monooleate), MYS-IEX (polyoxyethylene monostealate), and Hexagline 4-0 (hexaglyceryl tetraoleate) by Nikko Chemicals Co., Ltd.

The ink preferably contains a pigment dispersant in an amount of 0.1 to 20 percent by mass. Synergists dedicated to the respective pigments may be used as dispersion aids. The dispersant and dispersion aids are preferably added in amounts of 1 to 50 parts by mass for 100 parts by mass of pigments. A dispersion medium may be a solvent or a polymerizable compound. Preferably, the ink of the present invention, which is subjected to reaction and curing after printing or image formation, contains no solvent. Residual solvent in cured-ink images causes a decrease in solvent resistance and problems of remaining volatile organic compound (VOC). The preferred dispersion media are therefore polymerizable compounds, especially a monomer with the lowest viscosity rather than a solvent, in view of dispersion characteristics.

The pigment preferably has an average particle diameter in the range of 0.08 to 0.5 μm and a maximum diameter of 0.3 to 10 μm, more preferably 0.3 to 3 μm in view of dispersion of the pigment. These diameters are appropriately determined depending on the types of the pigment itself, dispersant, and dispersion medium, dispersion conditions, and filtration conditions. Such size control prevents nozzle clogging in the nozzles of the recording heads and leads to high storage stability, transparency, and curing sensitivity of the ink.

The ink of the present invention may optionally contain a known dye, preferably an oil-soluble dye. Non-limiting oil-soluble dyes that can be used in the present invention are listed below.

[Components of Ink: Magenta Dye]

MS Magenta VP, MS Magenta HM-1450, and MS Magenta HSo-147 (Mitsui Chemicals, Inc.); AIZENSOT Red-1, AIZEN SOT Red-2, AIZEN SOT Red-3, AIZEN SOT Pink-1, and SPIRON Red GEH SPECIAL (Hodogaya Chemical Co., Ltd.); RESOLIN Red FB 200%, MACROLEX Red Violet R, and MACROLEX ROT5B (Bayer); KAYASET Red B, KAYASET Red 130, and KAYASET Red 802 (Nippon Kayaku Co., Ltd.); PHLOXIN, ROSE BENGAL, and ACID Red (Daiwa Kasei Co., Ltd.); HSR-31 and DIARESIN Red K (Mitsubishi Chemical Corporation); and Oil Red (BASF Japan Ltd.).

[Components of Ink: Cyan Dye]

MS Cyan HM-1238, MS Cyan HSo-16, Cyan HSo-144, and MS Cyan VPG (Mitsui Chemicals, Inc.); AIZEN SOT Blue-4 (Hodogaya Chemical Co., Ltd.); RESOLIN BR.Blue BGLN 200%, MACROLEX Blue RR, CERES Blue GN, SIRIUS SUPRA TURQ.Blue Z-BGL, and SIRIUS SUPRA TURQ.Blue FB-LL 330% (Bayer); KAYASET Blue FR, KAYASET Blue N, KAYASET Blue 814, Turq.Blue GL-5 200, and Light Blue BGL-5 200 (Nippon Kayaku Co., Ltd.); DAIWA Blue 7000 and Oleosol Fast Blue GL (Daiwa Kasei Co., Ltd.); DIARESIN Blue P (Mitsubishi Chemical Corporation); and SUDAN Blue 670, NEOPEN Blue 808, and ZAPON Blue 806 (BASF Japan Ltd.).

[Components of Ink: Yellow Dye]

MS Yellow HSm-41, Yellow KX-7, and Yellow EX-27 (Mitsui Chemicals, Inc.); AIZEN SOT Yellow-1, AIZEN SOT YelloW-3, and AIZEN SOT Yellow-6 (Hodogaya Chemical Co., Ltd.); MACROLEX Yellow 6G and MACROLEX FLUOR.Yellow 10GN (Bayer); KAYASET Yellow SF-G, KAYASET Yellow 2G, KAYASET Yellow A-G, and KAYASET Yellow E-G (Nippon Kayaku Co., Ltd.); DAIWA Yellow 330HB (Daiwa Kasei Co., Ltd.); HSY-68 (Mitsubishi Chemical Corporation); and SUDAN Yellow 146 and NEOPEN Yellow 075 (BASF Japan Ltd.).

[Components of Ink: Black Dye]

MS Black VPC (Mitsui Chemicals, Inc.); AIZEN SOT Black-1 and AIZEN SOT Black-5 (Hodogaya Chemical Co., Ltd.); RESORIN Black GSN 200% and RESOLIN BlackBS (Bayer); KAYASET Black A-N (Nippon Kayaku Co., Ltd.); DAIWA Black MSC (Daiwa Kasei Co., Ltd.); HSB-202 (Mitsubishi Chemical Corporation); and NEPTUNE Black X60 and NEOPEN Black X58 (BASF Japan Ltd.).

The pigments or oil-soluble dyes are preferably added in amounts of 0.1 to 20 percent by mass, more preferably 0.4 to 10 percent by mass. Addition of 0.1 percent by mass or more yields desirable image quality, and addition of 20 percent by mass or less provides appropriate ink viscosity during ejection of ink. Two or more colorants may be appropriately used for color adjustment.

[Components of Ink: Photopolymerization Initiator]

The ink of the present invention preferably contains at least one photopolymerization initiator when ultraviolet rays, for example, are used as activating beams. For use of electron beams as activating beams, no photopolymerization initiator is necessary in many cases.

Photopolymerization initiators are broadly categorized into two types: an intramolecular bonding cleavage type and an intramolecular hydrogen abstraction type.

Photopolymerization initiators of the intramolecular bonding cleavage type include acetophenones, such as diethoxyacetophenone, 2-hydroxy-2-methyl-1-phenylpropan-1-one, benzyl dimethyl ketal, 1-(4-isopropylphenyl)-2-hydroxy-2-methylpropan-1-one, 4-(2-hydroxyethoxyl)phenyl 2-hydroxy-2-propyl ketone, 1-hydroxycyclohexyl phenyl ketone, 2-methyl-2-morpholino(4-thiomethylphenyl)propan-1-one, and 2-benzyl-2-dimethylamino-1-(4-morpholinophenyl)-butanone; benzoins, such as benzoin, benzoin methyl ethers, and benzoin isopropyl ethers; acylphosphine oxides, such as 2,4,6-trimethyl benzoin diphenylphosphine oxide; benzyl; and methyl phenylglyoxylate.

Photopolymerization initiators of the intramolecular hydrogen abstraction type include benzophenones, such as benzophenone, methyl-o-benzoylbenzoate-4-phenyl benzophenone, 4,4'-dichlorobenzophenone, hydroxybenzophenone, 4-benzoyl-4'-methyl diphenyl sulfide, acrylated benzophenone, 3,3',4,4'-tetra(t-butylperoxycarbonyl) benzophenone, and 3,3'-dimethyl-4-methoxy benzophenone; thioxanthones, such as 2-isopropylthioxanthone, 2,4-dimethylthioxanthone, 2,4-diethylthioxanthone, and 2,4-dichlorothioxanthone; aminobenzophenones, such as Michler's ketone and 4,4'-diethylamino benzophenone; 10-butyl-2-chloroacridone; 2-ethylanthraquinone; 9,10-phenanthrenequinone; and camphorquinone.

The preferred amount of a photopolymerization initiator, if used, is 0.01 to 10 percent by mass of an activating beam curable composition.

Examples of the radical polymerization initiators include triazine derivatives disclosed in documents, such as Japanese Examined Patent Application Publication Nos. S59-1281 and S61-9621, and Japanese Unexamined Patent Application Publication No. S60-60104; organic peroxides disclosed in documents, such as Japanese Unexamined Patent Application Publication Nos. S59-1504 and S61-243807; diazonium compounds disclosed in documents, such as Japanese Examined Patent Application Publication Nos. S43-23684, S44-6413, S44-6413, and S47-1604 and U.S. Pat. No. 3,567,453; organic azide compounds disclosed in documents, such as U.S. Pat. Nos. 2,848,328, 2,852,379, and 2,940,853; orthoquinonediazides disclosed in documents, such as Japanese Examined Patent Application Publication Nos. S36-22062, S37-13109, S38-18015, and S45-9610; onium compounds disclosed in documents, such as Japanese Examined Patent Application Publication No. S55-39162 and Japanese Unexamined Patent Application Publication No. S59-14023 and *Macromolecules,* 10, P. 1307, 1977; azo compounds disclosed in Japanese Unexamined Patent Application Publication No. S59-142205; metal allene complexes disclosed in documents, such as Japanese Unexamined Patent Application Publication No. H1-54440, EP patent Nos. 109,851 and 126, 712 and *J. Imag. Sci.,* 30, P.174, 1986; (oxo)sulfonium organoboron complexes disclosed in Japanese Patent Nos. 2711491 and 2803454; titanocenes disclosed in Japanese Unexamined Patent Publication No. S61-151197; transition metal complexes containing transition metals, such as ruthenium disclosed in *Coordination Chemistry Review,* 84, pp. 85-277, 1988 and Japanese Unexamined Patent Application Publication No. H2-182701; 2,4,5-triarylimidazole dimer; carbon tetrabromide disclosed in Japanese Unexamined Patent Application Publication No. H3-209477; and organic halogen compounds disclosed in Japanese Unexamined Patent Application Publication No. S59-107344. The preferred amount of a polymerization initiator ranges from 0.01 to 10 parts by mass for 100 parts by mass of a compound containing a radically polymerizable ethylenically unsaturated bond.

The ink of the present invention may contain a photoacid generator serving as a photopolymerization initiator.

As photoacid generators, compounds that are used, for example, for a chemically amplified photoresist or photo cationic polymerization are used (The Japanese Research Association for Organic Electronics Materials (ed.), *Organic materials for imaging*, pp. 187-192, BUNSHIN, 1993). Examples of such a compound suitable for the present invention are as follows.

First group: salts of aromatic onium compounds, such as diazonium, ammonium, iodonium, sulfonium, and phosphonium with $B(C_6F_5)_4^-$, $PF_6^-$, $AsF_6^-$, $SbF_6^-$, or $CF_3SO_3^-$.

Specific examples of the onium compound usable in the invention are disclosed in paragraph [0132] of Japanese Unexamined Patent Publication No. 2005-255821.

Second group: sulfonated compounds generating sulfonic acid. Specific examples of such a sulfonated compound are disclosed in paragraph [0136] of Japanese Unexamined Patent Publication No. 2005-255821.

Second group: halides photogenerating hydrogen halide. Specific examples of such a halide are disclosed in paragraph [0138] of Japanese Unexamined Patent Publication No. 2005-255821.

Third group: iron-allene complexes disclosed in paragraph [0140] of Japanese Unexamined Patent Publication No. 2005-255821.

[Components of Ink: Other Addictive Agents]

The activating beam curable ink of the present invention may also contain a variety of additives, other than those described above. Examples of such additives include surfactants, leveling agents, matting agents, polyester resins, polyurethane resins, vinyl resins, acrylic resins, gum resins, and waxes for adjusting membrane properties. Any known basic compound can be used for improvement in storage stability. Typical examples include basic alkali metal compounds, basic alkali earth metal compounds, and basic organic compounds, such as amines.

Specific examples of inks used in this embodiment are listed below.

Pigment dispersion elements for the following ink composition are obtained by heating and stirring a mixture of 5 parts by mass of SOLSPERSE 32000 (Lubrizol Corporation) and 80 parts by mass of HD-N (1,6-hexanediol dimethacrylate: Shin-Nakamura Chemical Co., Ltd.) in a stainless steel beaker to dissolve the mixture, cooling the mixture to room temperature, adding 15 parts by mass of Carbon Black #56 (Mitsubishi Chemical Corporation) to the mixture, putting the mixture and zirconia beads of 0.5 mm in a sealed glass vial, performing dispersion of the mixture with a paint shaker for 10 hours, and removing the zirconia beads therefrom.

TABLE 1

| | NAME | MANUFACTURER | AMOUNT (PART) |
|---|---|---|---|
| POLYMERIZABLE COMPOUND | A-600 | SHIN-NAKAMURA CHEMICAL CO., LTD. | 50 |
| POLYMERIZABLE COMPOUND | A-GLY-9E | SHIN-NAKAMURA CHEMICAL CO., LTD. | 5 |
| POLYMERIZABLE COMPOUND | HD-N | SHIN-NAKAMURA CHEMICAL CO., LTD. | 4.85 |
| PIGMENT DISPERSION ELEMENT | | | 20 |
| GELLING AGENT | KAO WAX T-1 | KAO CORPORATION | 5 |
| PHOTO-POLYMERIZATION INITIATOR | IRGACURE 379 | BASF | 3 |
| PHOTO-POLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 2

| | NAME | MANUFACTURER | AMOUNT (PART) |
|---|---|---|---|
| POLYMERIZABLE COMPOUND | 9G | SHIN-NAKAMURA CHEMICAL CO., LTD. | 35 |
| POLYMERIZABLE COMPOUND | U-200PA | SHIN-NAKAMURA CHEMICAL CO., LTD. | 5 |
| POLYMERIZABLE COMPOUND | 3G | SHIN-NAKAMURA CHEMICAL CO., LTD. | 19.85 |
| PIGMENT DISPERSION ELEMENT | | | 20 |
| GELLING AGENT | KAO WAX T-1 | KAO CORPORATION | 5 |
| PHOTO-POLYMERIZATION INITIATOR | DAROCUR TPO | BASF | 3 |
| PHOTO-POLYMERIZATION INITIATOR | PROCURE TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 3

| | NAME | MANUFACTURER | AMOUNT (PART) |
|---|---|---|---|
| POLYMERIZABLE COMPOUND | 14G | SHIN-NAKAMURA CHEMICAL CO., LTD. | 45 |
| POLYMERIZABLE COMPOUND | A-HD-N | SHIN-NAKAMURA CHEMICAL CO., LTD. | 14.85 |

TABLE 3-continued

| | NAME | MANUFACTURER | AMOUNT (PART) |
|---|---|---|---|
| PIGMENT DISPERSION ELEMENT | | | 20 |
| GELLING AGENT | KAO WAX T-1 | KAO CORPORATION | 5 |
| PHOTO-POLYMERIZATION INITIATOR | IRGACURE 379 | BASF | 3 |
| PHOTO-POLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 4

| | NAME | MANUFACTURER | AMOUNT (PART) |
|---|---|---|---|
| POLYMERIZABLE COMPOUND | UA-4200 | SHIN-NAKAMURA CHEMICAL CO., LTD. | 35 |
| POLYMERIZABLE COMPOUND | A-HD-N | SHIN-NAKAMURA CHEMICAL CO., LTD. | 24.85 |
| PIGMENT DISPERSION ELEMENT | | | 20 |
| GELLING AGENT | KAO WAX T-1 | KAO CORPORATION | 5 |
| PHOTO-POLYMERIZATION INITIATOR | IRGACURE 379 | BASF | 3 |
| PHOTO-POLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 5

| | NAME | MANUFACTURER | AMOUNT (PART) |
|---|---|---|---|
| POLYMERIZABLE COMPOUND | AD-TMP | SHIN-NAKAMURA CHEMICAL CO., LTD. | 30 |
| POLYMERIZABLE COMPOUND | A-GLY-9E | SHIN-NAKAMURA CHEMICAL CO., LTD. | 20 |
| POLYMERIZABLE COMPOUND | HD-N | SHIN-NAKAMURA CHEMICAL CO., LTD. | 9.85 |
| PIGMENT DISPERSION ELEMENT | | | 20 |
| GELLING AGENT | KAO WAX T-1 | KAO CORPORATION | 5 |
| PHOTO-POLYMERIZATION INITIATOR | IRGACURE 379 | BASF | 3 |

TABLE 5-continued

| | NAME | MANUFACTURER | AMOUNT (PART) |
|---|---|---|---|
| PHOTO-POLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 6

| | NAME | MANUFACTURER | AMOUNT (PART) |
|---|---|---|---|
| POLYMERIZABLE COMPOUND | U-200PA | SHIN-NAKAMURA CHEMICAL CO., LTD. | 13 |
| POLYMERIZABLE COMPOUND | A-GLY-9E | SHIN-NAKAMURA CHEMICAL CO., LTD. | 5 |
| POLYMERIZABLE COMPOUND | HD-N | SHIN-NAKAMURA CHEMICAL CO., LTD. | 41.85 |
| PIGMENT DISPERSION ELEMENT | | | 20 |
| GELLING AGENT | KAO WAX T-1 | KAO CORPORATION | 5 |
| PHOTO-POLYMERIZATION INITIATOR | IRGACURE 379 | BASF | 3 |
| PHOTO-POLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

[Control Configuration of Image Formation Device]

FIG. 5 is a block diagram showing the main control configuration of the image formation device 1. As shown in the drawing, the control unit 40 of the image formation device 1 is electrically connected to the paper feeding unit 10 to convey a recording medium P to the image formation unit 20, the drum rotation motor 53 to rotate the image formation drum 50, the suction circuit 54 for air suction for the drum 50, the ink heater 73 to heat the ink to be supplied to the heads 71, the inversion motor 861 to allow the rotation of the inversion drum 85, the first heater 91 to heat a recording medium P on the outer periphery of the image formation drum 50 before image formation, the temperature sensor 92 to detect the temperature of a recording medium P heated by the first heater 91, the irradiating unit 93 to irradiate with UV rays an ink image formed on a recording medium P, the second heater 94 to directly heat the outer periphery of the image formation drum 50 with no recording medium P between the second heater 94 and the image formation drum 50, the temperature sensor 95 to detect the temperature of the outer periphery of the image formation drum 50 heated by the second heater 94, and a head drive circuit 74 to drive the recording heads 71.

The control unit 40 is constituted of a ROM to store a program to control each component of the image formation device 1, a CPU to execute the program, and a RAM to serve as a work area at the time of the execution of the program, for example.

Further, an image memory circuit 42 to store the data of image to be formed inputted from a host computer, a higher-level device, via an interface circuit 41 is provided in addition to the control unit 40. The CPU of the control unit 40 performs computing on the basis of image data stored in the image memory circuit 42 and the program, and sends a control signal to each component on the basis of the computing results.

[Explanations of Behavior of Image Formation Device]

The behavior of the image formation device 1, having the above-described configuration, at the time of image formation on both sides of a recording medium P will now be described.

The image formation drum 50 is rotated by the drum rotation motor 53, the second heater 94 is turned on, and the outer periphery of the image formation drum 50 is heated to a target temperature on the basis of the temperature detected by the temperature sensor 95.

The control unit 40 controls the p per feeding unit 10 to intermittently convey a recording medium P to every other recording medium holding area on the image formation drum 50 which is being rotated.

The downstream end, in the conveyance direction, of the recording medium P supplied from the delivering unit 22 is caught with a nail part 51 of the image formation drum 50 at the supply position m1, and the recording medium P sticks to a holding area. The recording medium P that starts to be conveyed by the image formation drum 50 is heated to a predetermined target temperature by the first heater 91 controlled on the basis of the temperature detected by the temperature sensor 92.

A plurality of heads 71 of each head unit 70 are then driven to form an image based on image data.

The dots of the formed ink image are fixed through UV-ray irradiation from the irradiating unit 93 disposed downstream of the head units 70 in the conveyance direction.

When the nail part 51 holding the downstream end, in the conveyance direction, of the recording medium P comes to the reception position m2, the recording medium P is transferred to the first conveyance drum 81. At this time, the front side, on which an image has been formed, of the recording medium P comes into close contact with the outer periphery of the first conveyance drum 81, and the back side of the recording medium P is facing outward.

Further, when the nail part 811 holding the downstream end, in the conveyance direction, of the recording medium P comes to the transfer position m4, the recording medium P is transferred to the second conveyance drum 82. At this time, the back side of the recording medium P comes into close contact with the outer periphery of the second conveyance drum 82, and the front side of the recording medium P is facing outward.

When the nail part 821 of the second conveyance drum 82 passes the transfer position m5, the cam mechanism operates the nail part 821 so that the recording medium P goes forward without being transferred from the second conveyance drum 82 to the paper output drum 83. Further, when the nail part 821 holding the upstream end, in the conveyance direction, of the recording medium P comes to the transfer position m6, the recording medium P is transferred to the inversion drum 85. At this time, the front side of the recording medium P comes into close contact with the outer periphery of the inversion drum 85, and the back side of the recording medium P is facing outward.

Further, when the nail part 851 holding the downstream end, in the conveyance direction, of the recording medium P comes to the transfer position m8, the upstream end, in the conveyance direction, of the recording medium P (i.e., the end of the recording medium P opposite to the end held by the nail part 851) is close to and facing the tip of the of the inversion arm 86. The nail part 851 then cancels the holding state, and the upstream end, in the conveyance direction, of the recording medium P is caught by the tip of the inversion arm 86.

The inversion arm 86 then swings to the image formation drum 50, and the end of the recording medium P, which is on the upstream side on the inversion drum 85 in the conveyance direction, is pulled to the return position m9, with the back side of the recording medium P remaining facing outward. The image formation drum 50 is controlled so that a nail part 51 of an empty recording medium holding area comes to the return position m9 at the same time as the end of the recording medium P being pulled to the return position m9. The end of the recording medium P, which was originally on the upstream side in the conveyance direction, is caught by the nail part 51 with the back side of the recording medium P facing outward. Thus the recording medium P is turned over, comes into close contact with the outer periphery of the image formation drum 50, and passes the supply position m1. Image formation then is performed on the back side through the same process as that in the image formation on the front side.

When the image formation on the back side and UV irradiation are completed, the recording medium P is transferred from the image formation drum 50 to the first conveyance drum 81 at the reception position m2. On the first conveyance drum 81, the front side of the recording medium P is facing outward.

Further, the recording medium P is transferred from the first conveyance drum 81 to the second conveyance drum 82 at the transfer position m4. On the second conveyance drum 82, the back side of the recording medium P is facing outward.

The recording medium P is then transferred from the second conveyance drum 82 to the paper output drum 83 at the transfer position m5. On the paper output drum 83, the front side of the recording medium P is facing outward.

The recording medium P is then transferred from the paper output drum 83 to the paper output belt mechanism 84 at the transfer position m7, and the recording medium P is output to the paper output unit 30 with its back side facing outward.

[Technical Effects of Image Formation Device]

As described above, the image formation device 1 separates a recording medium P away from the outer periphery of the image formation drum 50 to turn over the recording medium P while conveying the recording medium P from the reception position m2 to the return position m9 in the conveyance direction F with the conveying mechanism 80. The second heater 94 thus heats the image formation drum 50 through the region from the reception position m2 to the return position m9, achieving efficient heating of the image formation drum 50 with no recording medium P between the second heater 94 and the image formation drum 50.

Further, the image formation device 1 uses ink having the property of changing phase depending on its temperature. Around the image formation drum 50, the second heater 94 that directly heats the outer periphery of the image formation drum 50, and the first heater 91 that heats a recording medium P on the outer periphery of the image formation drum 50 are provided. The recording medium P therefore can be maintained at a proper temperature before image formation is performed, achieving excellent image formation with stable quality.

Further, each head unit 70 is provided with the ink heater 73 to heat the ink to be supplied to the recording heads 71. This configuration enables a proper ink temperature before the ink ejection and thereby allows the ink to be ejected at a proper viscosity, achieving image formation with stable quality and enhancing reliability of the recording heads 71.

[Others]

Both of the first and second heaters 91 and 94 in the image formation unit 20 are non-contact heaters using infrared irradiation, but one of or both of the heaters 91 and 94 may be a contact heater.

Figure 6:
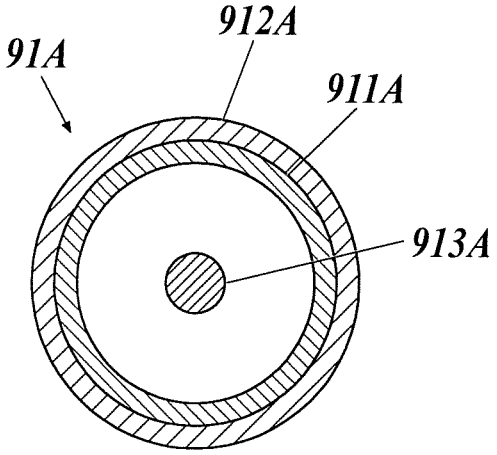
FIG. 6 is a cross-sectional diagram showing the schematic configuration of a heating roller as a contact heater.

FIG. 6 is a cross-sectional view showing the schematic configuration of a heating roller 91A as a contact heater. As shown in FIG. 6, the heating roller 91A includes a hollow pipe 911A composed of a metal such as aluminum; an elastic layer 912A, such as a silicon rubber, which covers the entire circumference of the hollow pipe 911A; and a heat source 913A, such as a halogen heater, which is built in the hollow pipe 911A to heat the hollow pipe 911A and the elastic layer 912A.

The elastic layer 912A is preferably made of material having good thermal conductivity. Further, the surface of the elastic layer 912A may be coated with a material (such as a PFA tube) which slides smoothly to improve durability.

The ink used for the image formation has properties of curing when irradiated with energy rays and changing phase depending on the ink temperature. The ink to be used, however, is not limited to such type of ink. An ink without the property of changing phase depending on its temperature, an ink without the property of curing when irradiated with energy rays, or an ink without any of these properties may be used for the image formation. In the case of using such types of inks, the temperature regulation with the heaters 91, 94, and 73 is meaningful if an ink to be used needs to be at a proper temperature for the image formation.

INDUSTRIAL APPLICABILITY

The present invention is applicable to the field of image formation devices to perform image formation on both sides of a recording medium where there is demand for image formation at a proper temperature.

REFERENCE NUMERALS

1 image formation device
10 paper feeding unit
12 conveying unit
20 image formation unit
22 delivering unit (recording medium supplying unit)
30 paper output unit
40 control unit
50 image formation drum
51 nail part
52 suction part
60 cleaning unit
70 head unit
71 recording head
73 ink heater
80 conveying mechanism
83 paper output drum (paper output path)
84 paper output belt mechanism (paper output path)
85 inversion drum (inversion path)
86 inversion arm (inversion path)
91 first heater (medium heater)
91A heating roller
93 irradiating unit (energy-ray irradiator)
94 second heater (drum heater)
711 nozzle
m1 supply position
m2 reception position
m9 return position
P recording medium

The invention claimed is:

1. An image formation device to eject ink to perform recording on a recording medium, the image formation device comprising:

an image formation drum which rotates in a predetermined direction to convey the recording medium held on an outer periphery of the image formation drum;

a recording medium supplying unit which supplies the recording medium to the image formation drum at a predetermined supply position;

a recording head including a plurality of nozzles to individually eject the ink onto the recording medium which has been supplied to the image formation drum, the nozzles being arranged in a direction perpendicular to a conveyance direction of the recording medium; and a conveying mechanism which receives the recording medium, onto which the ink has been ejected, from the image formation drum at a reception position downstream of the recording head in the conveyance direction, and conveys the recording medium selectively either to a paper output path for outputting the recording medium or to an inversion path for turning over the recording medium, wherein the conveying mechanism returns the turned-over recording medium to the image formation drum at a return position downstream of the reception position in the conveyance direction and upstream of the supply position in the conveyance direction; and a drum heater which heats a surface of the image formation drum is provided between the reception position and the return position.

2. The image formation device according to claim 1, wherein the ink has a property of curing when irradiated with energy rays; and an energy-ray irradiator is provided which irradiates the recording medium on the image formation drum with the energy rays at a position downstream of the recording head in the conveyance direction and upstream of the reception position in the conveyance direction.

3. The image formation device according to claim 1, further comprising an ink heater which heats the ink to be supplied to the recording head before the ink is ejected.

4. The image formation device according to claim 1, wherein the drum heater heats the image formation drum by non-contact heating.

5. The image formation device according to claim 1, wherein the drum heater heats the image formation drum by contact heating.

6. The image formation device according to claim 1, wherein the ink has a property of changing phase depending on a temperature of the ink.

7. The image formation device according to claim 1, further comprising a medium heater which heats a recording surface of the recording medium at a position downstream of the supply position in the conveyance direction and upstream of the recording head in the conveyance direction.

* * * * *